United States Patent [19]

Katoh

[11] 4,406,204

[45] Sep. 27, 1983

[54] ELECTRONIC MUSICAL INSTRUMENT OF FIXED FORMANT SYNTHESIS TYPE

[75] Inventor: Mitsumi Katoh, Hamamatsu, Japan

[73] Assignee: Nippon Gakki Seizo Kabushiki Kaisha, Hamamatsu, Japan

[21] Appl. No.: 296,217

[22] Filed: Aug. 25, 1981

[30] Foreign Application Priority Data

Sep. 5, 1980 [JP] Japan ..... 55-123150

[51] Int. Cl.[3] ..... G10H 1/02

[52] U.S. Cl. ..... 84/1.19; 84/1.01

[58] Field of Search ..... 84/1.19, 1.21, 1.01, 84/1.03, 1.24

[56] References Cited

U.S. PATENT DOCUMENTS

| | | | |
|---|---|---|---|
| 3,809,786 | 5/1974 | Deutsch | 84/1.01 |
| 4,018,121 | 4/1977 | Chowning | 84/1.01 |
| 4,192,210 | 3/1980 | Deutsch | 84/1.19 |
| 4,211,138 | 7/1980 | Deutsch | 84/1.19 |
| 4,267,761 | 5/1981 | Deutsch | 84/1.19 |
| 4,300,434 | 11/1981 | Deutsch | 84/1.19 |

FOREIGN PATENT DOCUMENTS

| | | |
|---|---|---|
| 54-81824 | 6/1979 | Japan . |
| 55-18623 | 2/1980 | Japan . |

*Primary Examiner*—F. W. Isen

*Attorney, Agent, or Firm*—Spensley, Horn, Jubas & Lubitz

[57] ABSTRACT

A musical tone is synthesized by controlling harmonic components of a note selected in a keyboard in accordance with a desired fixed formant. A parameter computation circuit detects a harmonic frequency which is nearest to a center frequency of the fixed formant and produces FM computation parameters using the nearest harmonic frequency as a carrier frequency and a fundamental or harmonic frequency of the selected note as a modulating frequency. A frequency modulation circuit performs an FM computation on the basis of these parameters and, as a result, a tone whose harmonic components have been controlled in accordance with a formant having the nearest harmonic frequency as a central component is synthesized. The parameter computation circuit computes frequency difference between the nearest harmonic frequency and the center frequency of the fixed formant for controlling the level of a formant synthesized in a frequency modulation circuit in accordance with this frequency difference. This level control is achieved by controlling an amplitude coefficient of a tone or a modulation index in the FM computation. A subformant having as its central component another harmonic frequency in the vicinity of the nearest harmonic frequency may be formed in a relatively low level for reinforcing the formant with this subformant.

19 Claims, 19 Drawing Figures

ELECTRONIC MUSICAL INSTRUMENT OF FIXED FORMANT SYNTHESIS TYPE

BACKGROUND OF THE INVENTION

This invention relates to an electronic musical instrument for realizing synthesis of a tone according to a fixed formant.

Natural musical instruments are known to have their own fixed formants peculiar to structures of the musical instruments such as a configuration of a sound-board in the case of a piano. A fixed formant exists in a human voice also and this fixed formant characterizes a tone color peculiar to a human voice. In order to simulate a tone color of a natural musical instrument or a human voice in an electronic musical instrument, a musical tone must be synthesized in accordance with a fixed formant peculiar to the tone color.

Several methods have been proposed for realizing a fixed formant in an electronic musical instrument. One is to use an analog type fixed filter. This method, however, is disadvantageous in that an analog type fixed filter having a sufficient Q(sharpness) for realizing a fixed formant is extremely expensive and that a fixed filter must be provided for each fixed formant or each tone color.

There are the following prior art digital type electronic musical instruments capable of synthesizing a tone on the basis of a fixed formant:

a. U.S. Pat. No. 3,809,786 entitled "Computer Organ;"
b. Japanese patent preliminary publication No. 1979-81824 entitled "Electronic Musical Instrument;"
c. U.S. Pat. No. 4,018,121 entitled "Method of Synthesizing a Musical Sound;"
d. Japanese patent preliminary publication No. 1980-18623 entitled "Electronic Musical Instrument".

The above listed U.S. Pat. No. 3,809,786 and Japanese patent preliminary publication No. 1979-81824 disclose the art of producing a partial tone signal for each harmonic component of a tone, multiplying it with an amplitude coefficient set for each harmonic and subsequently adding partial tone signals together to produce a tone signal of a desired spectrum structure. Such type of electronic musical instrument is convenient for synthesis of a tone in which the spectrum structure of respective harmonic components is not affected by change of its fundamental frequency, but is not suited for synthesis of a tone made on the basis of a fixed formant. For realizing a fixed formant is such type of electronic musical instrument, a set of harmonic amplitude coefficients which are different one key from another must be provided for each fixed formant. This requires a memory of a very large capacity.

The above mentioned U.S. Pat. No. 4,018,121 discloses the art of synthesizing a tone of a desired spectrum structure by a frequency modulation computation in an audio range. The Japanese patent preliminary publication No. 1980-18623 discloses the art of synthesizing a tone on the basis of a fixed formant by utilizing the frequency modulation computation.

According to the Japanese patent preliminary publication No. 1980-18623, a center frequency of a fixed formant is modified to a harmonic frequency which is nearest to the center frequency among harmonic frequencies of a tone designated by depression of a key and a formant having the modified center frequency (i.e. harmonic frequency) as its central component is synthesized by a frequency modulation computation. The reason for modifying the center frequency of the fixed formant to the nearest harmonic frequency is that side frequencies obtained by conforming a carrier frequency and a modulating frequency for the frequency modulation computation to a harmonic frequency of a desired tone constitute harmonic components of the tone. If, however, there is discrepancy between the formant center frequency and the harmonci frequency, the synthesized formant is somewhat different from a desired fixed formant. This difference poses a problem particularly when the fundamental frequency ($f_0$) of a tone to be generated is relatively high. An example of a spectrum envelope in a case where the fundamental frequency ($f_0$) is low is shown in FIG. 1(*a*) and an example of a spectrum envelope in a case where the fundamental frequency ($f_0$) is high is shown in FIG. 1(*b*). In these figures, solid lines designate spectrum envelopes of fixed formants to be synthesized and broken lines those of formants which are actually produced by the prior art method. In the case where the fundamental frequency ($f_0$) is low, the interval between respective harmonic frequencies ($f_0$, $2f_0$, $3f_0$ . . . ) is relatively narrow and accordingly, difference between center frequencies ($f_{f1}$, $f_{f2}$) of a desired fixed formant and harmonic frequencies ($3f_0$, $8f_0$) in the vicinity of the center frequencies is not so large, as shown in FIG. 1(*a*), and difference between a formant synthesized about the harmonic frequencies ($3f_0$, $8f_0$) and the desired fixed formant is of a negligible amount. In the case where the fundamental frequency ($f_0$) is high, however, the interval between harmonic frequencies ($f_0$, $2f_0$, $3f_0$ . . . ) is wide and difference between the center frequencies ($f_{f1}$, $f_{f2}$) of the desired fixed formant and the harmonic frequencies ($f_0$, $2f_0$) in the vicinity thereof is also wide. In this latter case, a formant synthesized about the harmonic frequencies ($f_0$, $2f_0$) is substantially distorted from the desired fixed formant as shown in FIG. 1(*b*) with a result that the tone color of the tone is adversely affected. For example, an original level of the harmonic frequency $2f_0$ in FIG. 1(*b*) is $l_0$ but an actual level thereof is L which is much higher than $l_0$ due to the shift of the formant as shown by the broken line. As a result, it is difficult to obtain a desired tone color.

SUMMARY OF THE INVENTION

It is, therefore, an object of the present invention to improve the above described deterioration in the tone color. For this purpose, the present invention is characterized in that difference in a signal level arising from change of a formant center frequency is corrected thereby to restore the signal level to a proper one in an electronic musical instrument of a type in which a center frequency of a fixed formant is modified to a frequency which is nearest to the center frequency among harmonic frequencies of a tone designated by depression of a key and a tone is synthesized on the basis of a formant having the modified center frequency as its central component. The basis concept of the invention is schematically shown in FIG. 2. In FIG. 2, a spectrum envelope of a desired fixed formant is designated by a solid line in the same manner as in FIG. 1 and a formant when a center frequency ($f_f$) is changed to a harmonic frequency ($kf_0$) in the vicinity thereof is designated by a broken line. Since the level of a central component of an original formant is L, the signal level of the harmonic frequency ($kf_0$) in the modified formant is L. In the orginal formant, however, the level of the harmonic frequency ($kf_0$) is $l_0$. In the present invention, difference between L and $l_0$ is made an amount of correction to correct the formant level and thereby obtain the original level $l_0$. The correction level l is obtained on the basis of a frequency difference $\Delta f$ between the original center frequency ($f_f$) and the modified center frequency ($kf_0$).

In a preferred embodiment of the invention, synthesis of a tone on the basis of a fixed formant is realized by a frequency modulation in an audio range using a formant center frequency as a carrier. Basically, a tone signal e(t) is synthesized by the following frequency modulation formula:

$$e(t)=A\sin(\omega_c t+I\sin\omega_m t) \quad (1)$$

where $\omega_c$ represents an angular frequency of a harmonic frequency ($kf_0$) which is nearest to an original formant center frequency ($f_f$), I a modulation index and $\omega_m$ an angular frequency of a modulating wave. For the angular frequency $\omega_m$, a fundamental frequency or harmonic frequencies thereof of a tone designated by depression of a key in a keyboard is generally used. According to the formula (1), multiple side frequencies are produced on either side of the angular frequency of the carrier $\omega_c$ at an interval of the angular frequency of the modulating wave $\omega_m$ whereby a formant having the angular frequency of the carrier $\omega_c$ as a central component can be formed. In the formula (1), A represents an amplitude coefficient and the level of an entire formant is determined by the amplitude coefficient.

In a preferred embodiment of the invention, the correction of a formant level is effected by controlling the amplitude coefficient A. If the level of the original formant center frequency ($f_f$) is expressed by L and a correction level corresponding to the frequency difference $\Delta f$ between the frequencies $f_f$ and $kf_0$ by l, the level correction can be achieved by giving a relation expressed by the following function to the amplitude coefficient A $$A=D\cdot(L-l) \quad (2)$$

The level correction can also be achieved by providing an amount of level correction l' corresponding to the frequency difference $\Delta f$ as a coefficient and giving a relation expressed by the following function to the amplitude coefficient A $$A=D\cdot(l'L) \quad (2')$$

In the formulas (2) and (2') D represents a coefficient determined by other amplitude determining factors. By implementing these formula, the entire level of a formant to be formed according to the invention is lowered as shown by a chain line in FIG. 2 and the level of the harmonic frequency ($kf_0$) which is made the central component of this formant constitutes the original level $l_0$.

The above formula (1) applies when a single formant is used. A tone generally consists of a plurality of formants. In this case, a tone signal e(t) is synthesized by the following formula:

$$e(t)=\sum_{i=1}^{N} A\,i\sin(\omega_{ci}t+Ii\sin\omega_{mi}t) \quad (3)$$

Where i represents an order (1, 2, 3, . . . N) of formants and N represents a total number of formants. The level correction according to the invention is made with respect to each of the formants.

The above described control of the entire level of the formant is fully effective for correcting the level of the harmonic frequency ($kf_0$) which constitutes the central component of the formant but is insufficient for correcting the level of harmonic frequencies in the vicinity of the frequency ($kf_0$). If, for example, harmonic frequencies ($kf_o$, $(k+1)f_0$) are included in a single formant as shown by solid lines in FIG. 3, not only the harmonic frequency ($kf_0$) which is nearest to the formant center frequency ($f_f$) but the harmonic frequency ($(k+1)f_0$) in the vicinity thereof have a level $l_0'$ which is determined by the formant. By shifting of a formant center to the position of the harmonic frequency ($kf_0$) as shown by a broken line, the level of the harmonic frequency ($(k+1)f_0$) in the vicinity of the harmonic frequency ($kf_0$) decreases from the original level $l_0'$. By controlling of the level of the formant shown by the broken line to a form shown by a chain line by the above described level correction, the level of the harmonic frequency ($(k+1)f_0$) further decreases from the original level $l_0'$. This phenomenon is remarkable particularly when the center frequency ($f_f$) of the original formant is about in the middle of the harmonic frequencies ($kf_0$) and ($(k+1)f_0$).

In the invention, therefore, two counterplans are proposed for compensating for shortage of level in frequencies about the harmonic frequency ($kf_0$) caused by shifting of the central component of the formant to its nearest frequency ($kf_0$). One of the counterplans (hereinafter referred to as "Counterplan 1") is to form, aside from a formant having a harmonic frequency ($kf_0$) nearest to a center frequency ($f_f$) of an original formant as its central component, another formant which has, as its central component, a harmonic frequency ($(k-1)f_0$ or $(k+1)f_0$) which is located next to the harmonic frequency ($kf_0$) across the center frequency ($f_f$) of the original formant. If, for example, the harmonic frequency ($kf_0$) nearest to the center frequency ($f_f$) of the original formant is lower than the center frequency ($f_f$), i.e., $kf_o<f_f$, as shown in FIG. 4(*a*), another formant as shown by a chain-and-dot line is formed with a harmonic frequency ($(k+1)f_0$) on a higher frequency side being employed as its central component. If the harmonic frequency ($kf_0$) is higher than the center frequency ($f_f$), i.e., $kf_0<f_f$ as shown in FIG. 4(*b*), another formant shown by a chain-and-dot line is formed with a harmonic frequency ($(k-1)f_0$) on a lower frequency side being employed as its central component. In a case of $kf_0=f_f$, there is no need to form such other formant. Although the entire level $l_0'$ of such other formant may be determined in accordance with difference between the center frequency ($f_f$) of the original formant and the harmonic frequency ($(k+1)f_0$ or $(k-1)f_0$) which constitutes a central component of the other formant, the entire level $l_0'$ of the other formant may be set at a certain fixed level which is adequate for reinforcing the level to a certain degree, for the other formant, after all, is a subordinate formant to the formant shown by the broken line in FIG. 4 which constitutes a primary formant. As described above, a desired formant (shown by the solid line in FIG. 4) can be realized by synthesis of two formants (shown by the broken line and the chain-and-dot line in FIG. 4) in accordance with the Counterplan I.

In a preferred embodiment, the tone signal e(t) according to the Counterplan I is basically synthesized by the following two term frequency modulation formula:

$$e(t) = \sum_{i=1}^{N} [A_i \sin(\omega_{ci}t + I_i \sin\omega_{mi}t) + A'_i \sin(\omega_{c'i}t + I'_i \sin\omega_{m'i}t)] \quad (4)$$

where $\omega_{ci}$ represents an angular frequency of a harmonic frequency ($kf_0$) which is nearest to the center frequency ($f_f$) of an i-th formant and $\omega_{c'i}$ represents an angular frequency of a harmonic frequency which is next to the nearest harmonic frequency ($kf_0$) to the center frequency ($f_f$) of the i-th formant (i.e., $(k+1)f_0$ in the case of $kf_0 < f_f$ and $(k-1)f_0$ in the case of $kf_0 > f_f$). In a case where the harmonic frequency ($kf_0$) is equal to the center frequency ($f_f$), i.e., $kf_0 = f_f$, A'i is assumed to be zero.

Another counterplan (hereinafter referred to as "Counterplan II") utilizes a phenomenon that a spectrum envelope obtained by a frequency modulation gets flattened as a modulation index increases and controls the modulation index (I, Ii) in the formula (1) or (3) in accordance with frequency difference Δf between the center frequency ($f_f$) and the nearest harmonic frequency ($kf_0$) or the level correction amount l(FIG. 2). If, for example, the frequency difference Δf between the center frequency $f_f$ of an original formant (shown by a solid line) and the harmonic frequency ($kf_0$) nearest thereto is relatively small as shown in FIG. 5(*a*), the modulation indices (I, Ii) are made somewhat larger than original values depending upon the frequency difference Δf whereby a formant (shown by a broken line) which is somewhat flattened as compared with the original formant is formed about the harmonic frequency ($kf_0$). If the frequency difference Δf is relatively large as shown in FIG. 5(*b*), the modulation indices (I, Ii) are made large in accordance with the frequency difference Δf whereby a formant (shown by a broken line) which is more flattened is formed about the harmonic frequency ($kf_0$). By this arrangement, not only the level on the harmonic frequency ($kf_0$) constituting the formant (broken line) is automatically corrected but also the level of harmonic frequencies about the frequency ($kf_0$) is corrected.

The object of the present invention can be achieved by previously having data for synthesizing a fixed formant corresponding to a desired tone color with respect to each key. Since a harmonic frequency nearest to a center frequency of a desired formant with respect to each key is previously known, the frequency difference Δf, i.e., the level correction amount l can also be previously known. Accordingly, if parameters for synthesizing a desired fixed formant are prestored with respect to each key after a numerical correction necessary for the level correction has been applied to these parameters with respect to each key and parameters corresponding to the depressed key are read out for synthesizing the formant, a formant for which the level correction has been made with respect to each key can be synthesized. Although storing of the parameter necessary for synthesizing a fixed formant with respect to each key requires a memory device of an increased capacity, increase in data to be stored is not substantial in an electronic musical instrument which has a relatively small number of keys so that increase in the memory capacity is not substantial and this storing of parameters is very effective for achieving the object of the present invention.

BRIEF DESCRIPTION OF THE DRAWINGS

In the accompanying drawings.

DESCRIPTION OF PREFERRED EMBODIMENTS

Figure 6:
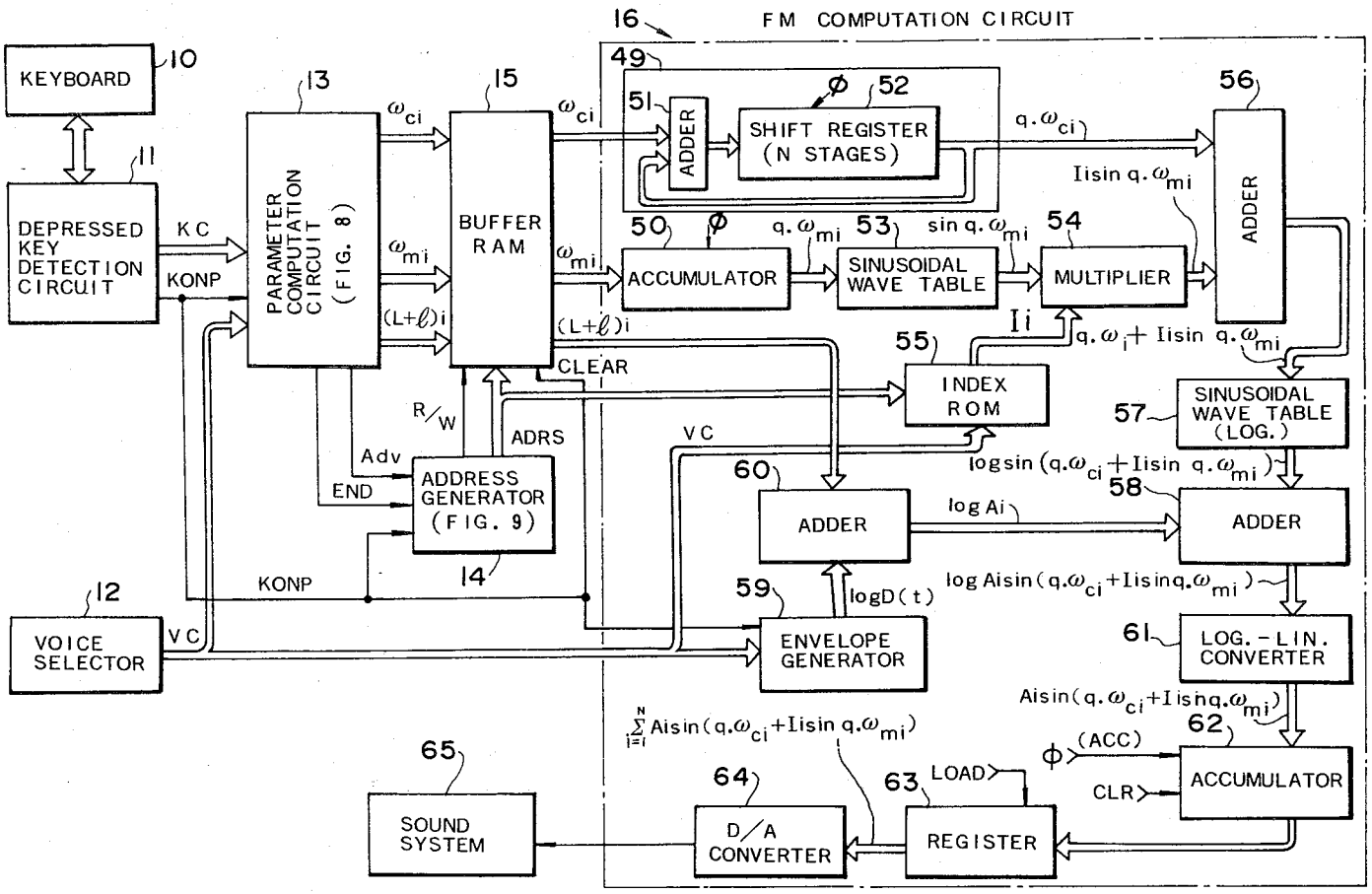
FIG. 6 is a block diagram showing an entire structure of an embodiment of the electronic musical instrument made according to the invention.

In the embodiment of the electronic musical instrument shown in FIG. 6, correction of the level is made with respect to an amplitude coefficient $A_i$ in accordance with a function represented by the above described formula (2) or formula (2') and synthesis of a tone (i.e., synthesis of a formant) is effected in accordance with the above described formula (3). A keyboard 10 comprises a plurality of keys among which a selected key is depressed for designating a fundamental frequency ($f_0$) of a tone. It should be noted that the term "tone" is employed herein to designate not only a sound of a musical instrument or a human voice but a sound in general. A depressed key detection circuit 11 detects a key being depressed in the keyboard 10 and, upon the detection, outputs a key code KC consisting of a codified signal of plural bits and identifying the depressed key and, when the key has been depressed, one shot of key-on pulse KONP of a short duration. A voice selector 12 constitutes means for selecting a tone color of a tone to be synthesized and outputs a voice code VC consisting of plural bits and identifying the selected tone colour. Since a tone is synthesized on the basis of a fixed formant in the present invention, the selection of a desired tone by the voice selector 12 signifies selection of a desired fixed formant. Accordingly, a desired fixed formant is designated by the voice code VC.

Figure 7:
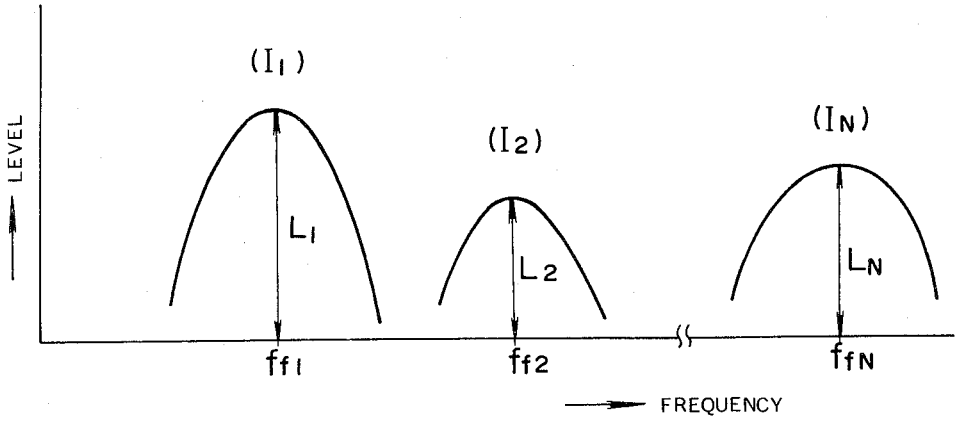
FIG. 7 is a diagram showing a typical example of the fixed formant by a spectrum envelope.

A typical example of a fixed formant is exhibited in FIG. 7. One fixed formant selected by the voice selector 12 consists of N formants (N being any desired integer selected in accordance with a selected circuit design). An order of i is used for distinguishing individual formants from one another. The order i is 1, 2, 3, . . . N which is affixed to characters representing center frequencies of the respective formants in the order of the lowest frequency to higher frequencies. In FIG. 7, three formants of i=1, i=2 and i=N only are shown and illustration of other formants between the formant $F_{f2}$ and $f_{fN}$ is omitted. The center frequency $f_{fi}$ (i.e., $f_{f1}$, $F_{f2}$, . . . $f_{fN}$) and a level Li(i.e., $L_i$, $L_2$, . . . $L_N$) of the respective formants and spectrum envelopes of these formants assume values and shapes proper to individual tone colors (i.e. fixed formants) which are selectable by the voice selector 12. The spectrum envelope of each formant (i) is determined by a modulation index ($Ii=I_1$, $I_2$, . . . $I_N$).

A parameter computation circuit 13 is a circuit provided for computing parameters $\omega_{ci}$, $\omega_{mi}$ and $(L+\omega)_i$ required for synthesizing of a formant in accordance with a frequency modulation method. The parameter $\omega_{ci}$ is data representing a harmonic frequency $kf_0$ which is nearest to the center frequency $f_{fi}$ of the i-th formant among harmonic frequencies of the tone designated by the key code KC for the depressed key, i.e., data corresponding to an angular frequency of a carrier in the frequency modulation. $\omega_{mi}$ is data representing an angular frequency of a modulating wave in a frequency modulation computation for synthesizing the i-th formant. In this embodiment, data representing the fundamental frequency $f_0$ of the tone for the depressed key designated by the key code KC is employed as the data $\omega_{mi}$. $(L+l)_i$ is data representing a level $L_i$ of a central component of the i-th formant corrected by a level correction amount $l_i$ corresponding to difference $\Delta f$ between the harmonic frequency $Kf_0$ which is used as the carrier wave ($\omega_{ci}$) and the original center frequency $f_{fi}$.

The parameter computation circuit 13 is reset by a key-on pulse KONP immediately upon depression of the key and thereafter effects computation for obtaining the above described parameter on the basis of the key code KC and the voice code VC. An address generator 14 also is reset by the key-on pulse KONP and sets a buffer RAM 15 to a write mode immediately after the depression of the key. The buffer RAM 15 also is cleared by the key-on pulse KONP in the entire area thereof. In the buffer RAM 15, the respective data $\omega_{ci}$, $\omega_{mi}$, and $(L+l)_i$ obtained by the parameter computation circuit 13 initially is loaded at addresses designated by the address generator 14. Upon completion of the computation in the parameter computation circuit 13, a computation end signal END is fed to the address generator 14 and, in response to this signal, the buffer RAM 15 is switched to a read mode. Upon switching of the RAM 15 to the read mode, the data $\omega_{ci}$, $\omega_{mi}$ and $(L+l)_i$ is read from the area having the addresses of the buffer RAM 15 designated by the address generator 14. The data $\omega_{ci}$, $\omega_{mi}$ and $(L+l)_i$ read from the buffer RAM 15 is applied to an FM computation circuit 16(FM being an abbreviation of frequency modulation). In the FM computation circuit 16, a formant is formed by the frequency modulation computation as shown by the formula (3) and a tone signal constituted of this formant is generated.

The embodiment shown in FIG. 6 will further be described in detail with reference to the example of the parameter computation circuit 13 shown in FIG. 8 and the example of the address generator 14 shown in FIG. 9.

Figure 8:
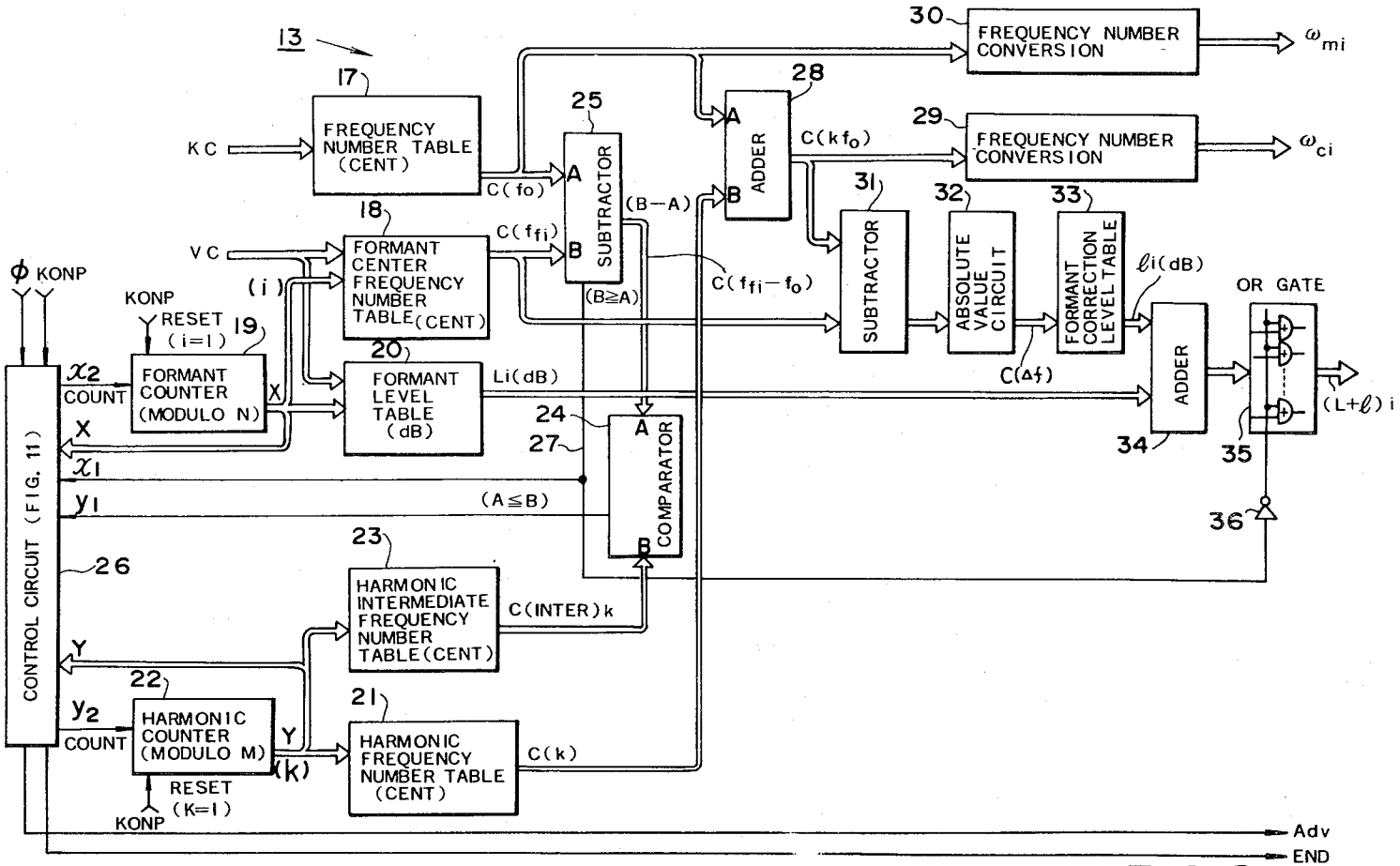
FIG. 8 is a block diagram showing, in detail, an example of a parameter computation circuit appearing in FIG. 6.

In FIG. 8, a frequency number table 17 prestores numerical values (i.e. frequency numbers) corresponding to fundamental frequencies $f_0$ of the respective keys and provides a frequency number C ($f_0$) corresponding to the depressed key in accordance with the key code KC supplied by the depressed key detection circuit 11(FIG. 6). The frequency numbers $C(f_0)$ stored in this frequency number table 17 represent tone pitches of the respective keys in cent, the tone pitch of the lowest key (e.g. $C_2$) being taken as a reference (i.e. zero cent). An example of relationship between the keys and the values (cents) of the frequency numbers $C(f_0)$ stored in the table 17 is shown in Table 1.

TABLE 1

| Frequency number table 17 | |
|---|---|
| Key (key code KC) | $C(f_0)$ |
| $C_2$ | 0 (cent) |
| C # 2 | 100 |
| $D_2$ | 200 |
| D # 3 | 300 |
| . | . |
| . | . |
| . | . |
| $C_3$ | 1200 |
| . | . |
| . | . |
| . | . |
| $C_4$ | 2400 |
| . | . |
| . | . |

A formant center frequency number table 18 prestores numerical values (i.e. frequency numbers) corresponding to formant center frequencies $f_{fi}$ for respective tone colors. A set of formant center frequencies $f_{fi}$ constituting a desired fixed formant is selected in accordance with voice code VC provided by the voice selector 12 (FIG. 6) and a frequency number $C(f_{fi})$ corresponding to a center frequency $f_{fi}$ of the i-th formant is read out among the set of formant center frequencies in accordance with an output X of a formant counter 19. The frequency numbers $C(f_{fi})$ stored in the formant center frequency number table 18 represent, just as the frequency numbers $C(f_0)$ of the table 17, respective frequencies $f_{fi}$ in cent, the frequency of the lowest key ($C_2$) being taken as a reference (i.e., zero cent).

A formant level table 20 prestores levels $L_i$ of respective formants for each tone color. A set of levels Li is selected in accordance with the voice code VC and data $L_i$(dB) representing the level $L_i$ of the i-th formant is read out among the set of levels in response to the output X of the formant counter 19. This level data Li(dB)

stored in the table 20 expresses a signal by an amount of attenuation. If, for example, the level data Li(dB) is the smallest value (0 dB), it represents a minimum amount of attenuation, i.e., the largest signal level whereas if the level data $L_i$ is the largest value ($\infty$ dB), it represents a maximum amount of attenuation, i.e., the smallest signal level (0 level).

A harmonic frequency number table 21 prestores data of respective harmonic frequencies expressed in cent with the fundamental frequency $f_0$ being taken as a reference (0 cent) and provides a harmonic frequency number C(k) representing a cent value of a k-th harmonic frequency in response to an output Y of a harmonic counter 22. The reference character k represents an order of the harmonic frequencies. Relationship between the orders k stored in the table 21 and values (in cent) of the harmonic frequency numbers C(k) is shown in Table 2.

TABLE 2

| Harmonic frequency number table 21 | |
|---|---|
| Order k (U) | C(K) |
| 1 | 0 (cent) |
| 2 | 1200 |
| . | . |
| . | . |
| . | . |

A harmonic intermediate frequency number table 23 prestores harmonic intermediate frequency numbers C(INTER)K representing intermediate frequencies between the respective harmonic frequencies and provides a frequency number C(INTER)k representing an intermediate frequency between a k-th harmonic frequency and a harmonic frequency (k+1) which is higher by one order in response to the output Y of the harmonic counter 22. This intermediate frequency number C(INTER)k is data of each intermediate frequency (expressed in cent) between respective harmonics, with the fundamental frequency (the first harmonic frequency) $f_0$ being taken as a reference. Values in cent of the intermediate frequency numbers C(INTER)k read out in response to the output Y of the harmonic counter 22 are shown in Table 3.

TABLE 3

| Harmonic intermediate number Table 23 | |
|---|---|
| Y | C(INTER)k |
| 1 | 600 (cent) |
| 2 | 1550 |
| 3 | 2150 |
| . | . |
| . | . |
| . | . |

For example, the value "600 cents" of the intermediate frequency number C(INTER)k which is read when the output Y of the harmonic counter 22 is "1" represents a value of an intermediate frequency $$\left(\frac{f_0 + 2f_0}{2}\right)$$

between the fundamental and the second harmonic in terms of cent relative to the fundamental.

Each intermediate frequency $$\left(\frac{kf_0 + (k+1)f_0}{2}\right)$$

between the respective harmonics is utilized for judging whether a k-th harmonic frequency $kf_0$ is the nearest frequency to the center frequency $f_{fi}$ of the formant. If the k-th harmonic frequency $kf_0$ is the nearest frequency to the center frequency $f_{fi}$ of the formant, the center frequency $f_{fi}$ comes between two adjacent intermediate frequency $$\left(\frac{(k-1)f_0 + kf_0}{2}\right) \text{ and } \left(\frac{kf_0 + (k+1)f_0}{2}\right).$$

In other words, a harmonic frequency $kf_0$ is the nearest frequency to the center frequency $f_{fi}$ when a condition $$\frac{(k-1)f_0 + kf_0}{2} < f_{fi} \leqq \frac{kF_0 + (k+1)f_0}{2} \quad (5)$$

is satisfied. Accordingly, whether a condition $$f_{fi} \leqq \frac{kf_0 + (k+1)f_0}{2} \quad (6)$$

is satisfied or not is examined by comparing the center frequency of the formant with the harmonic frequency and changing the value of k one by one from the lowest order to higher orders. The formula (5) is satisfied with respect to the value of k about which the formula (6) is first satisfied in the course of the comparison performed by changing the value of k toward higher orders (i.e., in the order of 1, 2, 3 . . . ). If the value of k exceeds it, the condition of the left side of the formula (5), i.e.

$$\frac{(k-1)f_o + kf_0}{2} < f_{fi}$$

is no longer satisfied, though the formula (6) is satisfied. Accordingly, the k-th harmonic frequency $kf_0$ corresponding to the value of k which first satisfies the formula (6) (the smallest value of k which satisfies the formula (6)) constitutes the harmonic frequency nearest to the center frequency $f_{fi}$. The method of utilizing the harmonic intermediate frequencies is advantageous over the method of detecting the nearest harmonic frequency by computing differences in frequency between the formant center frequency and the respective adjacent harmonic frequencies in that the former is simpler in the circuit design.

A comparator 24 shown in FIG. 8 is provided for performing the comparison of the formula (6). The comparator 24 receives, at its B input, an intermediate frequency number C(INTER)k for a harmonic intermediate frequency $$\left(\frac{kf_0 + (k+1)f_0}{2}\right)$$

corresponding to the k-th harmonic frequency $kf_0$. The comparator 24 receives, at its A input, an output $C(f_{fi}-f_0)$ of a subtractor 25. The subtractor 25 receives, at its A input, a frequency number $C(f_0)$ representing the fundamental frequency $f_0$ of the depressed key and, at its B input, the frequency number $C(f_{fi})$ of the formant center frequency $f_{fi}$ read from the table 18. The subtractor 25 conducts subtraction B−A. More specifically, the subtractor 25 subtracts the fundamental frequency number $C(f_0)$ from the formant center frequency $C(f_{fi})$ and, as a result, provides from its output (B−A) data $C(f_{fi}-f_0)$ representing a cent value of the center frequency $f_{fi}$ with the fundamental frequency $f_0$ being taken as a reference. The intermediate frequency number C(INTER)k applied to the B input of the comparator 24 is expressed in a cent value relative to the fundamental $f_0$ which is taken as a reference (0 cent) whereas the center frequency number $C(f_{fi})$ read from the table 18 is expressed in a cent value relative to the lowest key $C_2$ which is taken as a reference (0 cent). Accordingly, the references in the two frequency numbers are different from each other. Accordingly, the data $C(f_{fi}-f_0)$ representing a cent value of the formant center frequency $f_{fi}$ with the fundamental frequency $f_0$ being taken as a reference (0 cent) is computed and applied to the A input of the comparator 24 to match the references of the cent values of the A and B inputs.

The frequency number $C(f_0)$ for which the fundamental frequency $f_0$ of the depressed key is expressed in cent is expressed by the following formula where $f_{c2}$ represents the fundamental frequency of the lowest key C2:

$$C(f_0) = 1200 \log_2 \frac{f_0}{f_{c2}} \tag{7}$$

The frequency number $C(f_{fi})$ for which the formant center frequency $f_{fi}$ is expressed in cent is expressed by the following formula:

$$C(f_{fi}) = 1200 \log_2 \frac{f_{fi}}{f_{c2}} \tag{8}$$

Since the data $C(f_{fi}-f_0)$ obtained by the subtraction in the subtractor 25 is a result of subtraction of the formula (8) from the formula (7), the data $C(f_{fi}-f_0)$ is expressed by the following formula:

$$\begin{aligned} C(f_{fi}-f_0) &= 1200\left(\log_2 \frac{f_{fi}}{f_{c2}} - \log_2 \frac{f_0}{f_{c2}}\right) \\ &= 1200 \log_2 \frac{f_{fi}}{f_{c2}} \cdot \frac{f_{c2}}{f_0} \\ &= 1200 \log_2 \frac{f_{fi}}{f_0} \end{aligned} \tag{9}$$

As will be apparent from the formula (9), the data $C(f_{fi}-f_0)$ applied to the A input of the comparator 24 is data representing a cent value of the formant center frequency $f_{fi}$ with the fundamental frequency $f_0$ being taken as a reference.

The comparator 24 compares the data applied to its A input with the data applied to its B input and outputs a signal "1" when the data A is equal to or smaller than the data B, i.e., A≦B. A≦B signifies that the data C(INTER)k representing the harmonic intermediate frequency is equal to or larger than the data $C(f_{fi}-f_0)$ representing the formant center frequency, that is, the conditions of the formula (6) have been satisfied. The output of the comparator 24 (A≦B) is applied to a control circuit 26 as a nearest harmonic detection signal yl.

The subtractor 25 outputs a signal "1" on a line 27 when the result of the subtraction (B−A) is a positive value. This signal "1" on the line 27 represents that the formant center frequency $f_{fi}$ is equal to the fundamental frequency $f_0$ or on the higher side of the fundamental frequency $f_0$. If a signal on the line 27 is "0", this signal "0" represents that the formant center frequency $f_{fi}$ is on the lower side of the fundamental frequency $f_0$ and it is not necessary to form the formant in this case. The signal on the line 27 is applied to the control circuit 26 as a search instruction signal xl.

An adder 28 receives the fundamental frequency number $C(f_0)$ read from the frequency number table 17 and the harmonic frequency number C(k) read from the harmonic frequency number table 21 and adds these frequency numbers together. As a result of the addition, data $C(kf_0)$ representing a cent value of the harmonic frequency $kf_0$ when the lowest key C2 is taken as a reference (0 cent) is obtained. Since the harmonic frequency number C(k) read from the table 21 is a cent value with the fundamental frequency $f_0$ being taken as a reference(l cent), this cent value is converted by the adder 28 to a cent value for which the lowest key C2 is taken as reference (0 cent). The fundamental frequency number $C(f_0)$ is expressed in the above described manner and the harmonic frequency number C(k) is expressed by the following formula:

$$C(k) = 1200 \log_2 \frac{kf_0}{f_0} \tag{10}$$

Accordingly, a harmonic frequency number $C(kf_0)$ can be expressed by the following formula:

$$\begin{aligned} C(kf_0) &= 1200\left(\log_2 \frac{f_0}{f_{c2}} + \log_2 \frac{kf_0}{f_0}\right) \\ &= 1200 \log_2 \frac{f_0}{f_{c2}} \cdot \frac{kf_0}{f_0} \\ &= 1200 \log_2 \frac{kf_0}{f_{c2}} \end{aligned} \tag{11}$$

As will be appreciated from the formula (11), the harmonic frequency number $C(kf_0)$ obtained from the adder 28 represents a cent value of the harmonic frequency $kf_0$ with the frequency $f_{c2}$ of the lowest key c2 being taken as a reference.

Frequency number conversion circuits 29 and 30 are provided for converting the frequency numbers $C(kf_0)$ and $C(f_0)$ expressed in cent to numerical values which are proportional to original frequencies (i.e., data representing increments of phase per unit time). If a frequency corresponding to a cent value C(x) is rexpressed by f(x), there exists a relation $$C(x) = 1200 \log_2 \frac{f(x)}{f_{c2}}. \tag{12}$$

Accordingly, f(x) can be calculated by an exponential function $$f(x) = f_{c2} \cdot 2^{\frac{c(x)}{1200}} \quad (13)$$

The frequency number conversion circuits 29 and 30, therefore, input data corresponding to the cent values C(x) and output numerical values proportional to the frequencies f(x) calculated by the formula (13) i.e. numerical values obtained by multiplying f(x) by a suitable constant. These frequency number conversion circuits 29 and 30 can be composed of read-only memories.

The frequency number conversion circuit 29 converts the harmonic frequency number $C(kf_0)$ in cent provided by the adder 28 to frequency data (phase increment value data) $\omega_{ci}$ proportional to the harmonic frequency $kf_0$. Likewise, the frequency number conversion circuit 30 converts the frequency number $C(f_0)$ in cent provided by the frequency number table 17 to frequency data (phase increment value data) $\omega_{mi}$ proportional to the frequency $f_0$.

A subtractor 31 receives the harmonic frequency number $C(kf_0)$ outputted by the adder 28 and the center frequency number $C(f_{fi})$ read from the formant center frequency table 18 and produces difference between the two frequency numbers. The difference provided by the subtractor 31 is applied to an absolute value circuit 32 where an absolute value of the difference is computed. Accordingly, the absolute value circuit 32 provides frequency difference data $C(\Delta f)$ which corresponds to difference $\Delta f$ between the formant center frequency $f_{fi}$ and the harmonic frequency $kf_0$. The frequency difference data $C(\Delta f)$ is applied to a formant correction level table 33 and data li(dB) representing level correction amount li corresponding to the frequency difference $\Delta f$ is read from the table 33. The formant correction level table 33 prestores a relation between frequency difference $\Delta f$ from the formant center frequency $f_{fi}$ and a correction level l required in correspondence thereto. The correction level amount data li(dB) stored in the table 33 is expressed by an amount of attenuation as in the table 20.

Figure 1A:
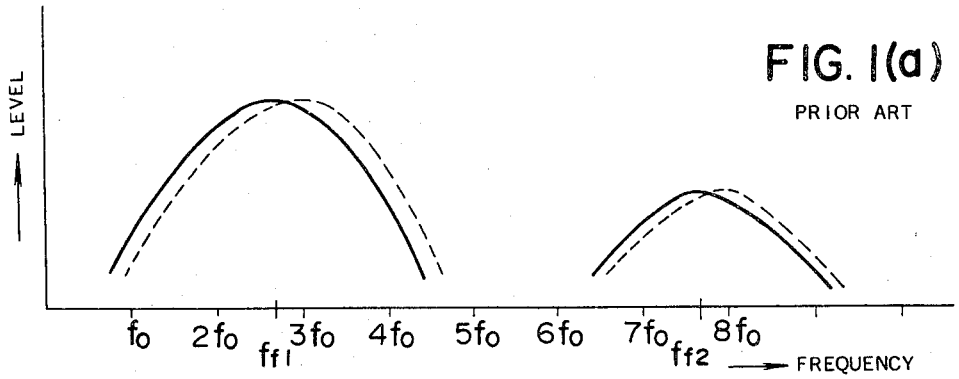
FIG. 1(a) PRIOR ART
FIGS. 1(*a*) and 1(*b*) are diagram respectively showing an example of a spectrum envelope of an original fixed formant and an example of a spectrum envelope in a case where its center frequency has been shifted to its nearest harmonic frequency by a prior art method.
Figure 1B:
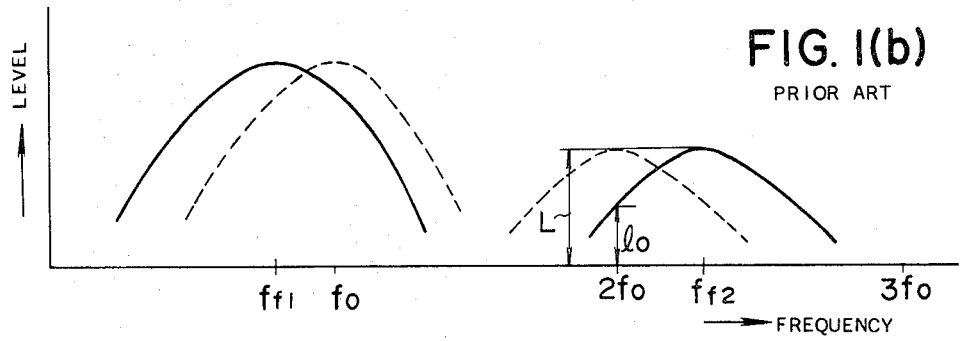
FIG. 1(b) PRIOR ART
Figure 2:
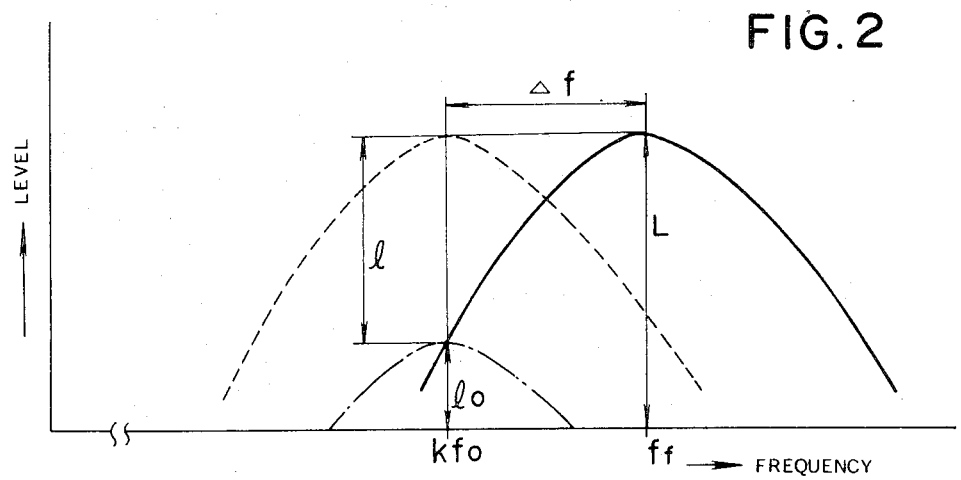
FIG. 2 is a spectrum envelope diagram for schematically explaining correction of the level of a formant according to the present invention.
Figure 3:
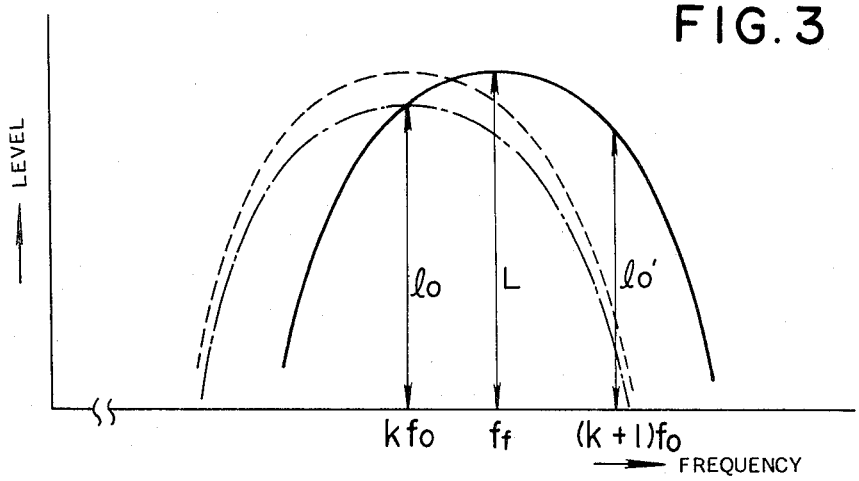
FIG. 3 is a spectrum envelope diagram showing occurrence of an error in the level of a harmonic frequency component which is adjacent to a harmonic frequency nearest to the center frequency of a formant.

The correction level data li(dB) read from the table 33 is applied to an adder 34 where it is added to the level data Li(dB) representing the center frequency component of the formant. The computation (l'·L) for the formula (2') is substantially effected by this addition in the adder 34. The addition of the Li(dB) and li(dB) expressed in the amount of attenuation corresponds to a logarithmic addition and substantially is multiplication of the attenuation amount data Li(dB) representing the level Li of the center component of the i-th formant by the data li(dB) representing the level correction coefficient corresponding to the frequency difference $\Delta f$. The output of the adder 34 is data representing an original level $l_0$(FIG. 2) after the level correction by an amount of attenuation. With reference to FIG. 2, this will be schematically explained in the following manner. By adding the level correction data li(dB) corresponding to the correction level l to the data Li(dB) representing the amount of attenuation for obtaining the level L, the amount of attenuation is augmented and data representing the amount of attenuation (larger than Li(dB)) for obtaining the original level $l_0$ which is lower than the level L is obtained. Accordingly, the computation in the adder 34 brings about a result equivalent to the computation (L−l) of the formula (2).

The output of the adder 34 is outputted as data $(L+l)_i$ representing a formant level after the level correction through an OR gate group 35. The OR gate group 35 is provided for compulsorily changing the level data $(L+l)_i$ to data representing a minimum level (∞ dB) when the signal on the line 27 is "0". The signal on the line 27 normally is "1" and a signal "0" produced by inverting this signal "1" by an inverter 36 is supplied to the OR gate group 35. Accordingly, the output of the adder 34 is normally outputted as the level data $(L+l)_i$, passing through the OR gate group 35. When the signal on the line 27 has been turned to "0", the output of the inverter 36 is turned to "0" which is applied to all OR gates of the OR gate group 35 so that all bits of the level data (L+l)i are compulsorily turned to "1". The fact that all bits of the level data (L+l)i representing the amount of attenuation are "1" (i.e., a maximum value ∞ dB) represents a maximum attenuation, i.e., a minimum level (the signal level is 0).

Figure 10:
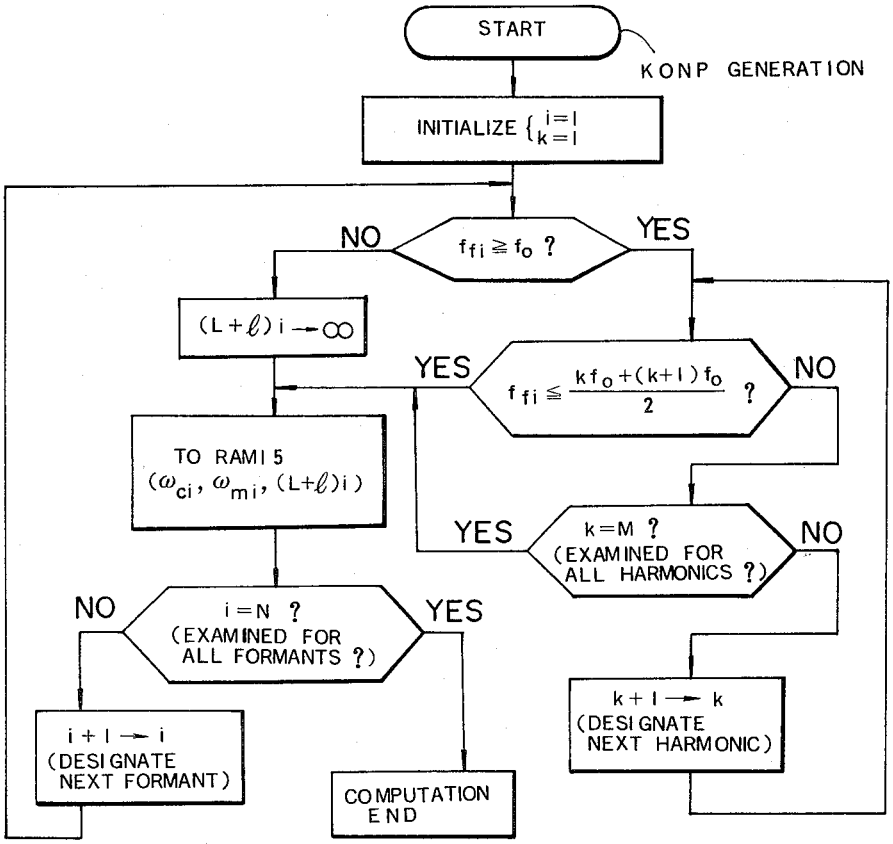
FIG. 10 is a flow chart showing an outline of a sequence of operation of the parameter computation circuit appearing in FIG. 8.

FIG. 10 is a flow chart for explaining the operation order in the parameter computation circuit 13 shown in FIG. 8. A series of the parameter computation operation starts upon receipt of the key-on pulse KONP. In an "Initialize" step, the order i of the format is set at a minimum value 1(i=1) and the order k of the harmonic is set at 1(k=1). This is effected by resetting the formant counter 19 and the harmonic counter 22 in FIG. 8 by the key-on pulse KONP. By this resetting, the output X of the counter 19 and the output Y of the counter 22 are respectively set at "1". The output X of the counter 19 represents the order i of the formant which is a present object of computation whereas the output Y of the counter 22 represents the order k of a harmonic frequency which is a present object of computation. The counter 19 has at least a modulo equivalent to a maximum number N of formants constituting one fixed formant. The harmonic counter 22 is of a modulo M corresponding to a maximum number of harmonics M.

Accordingly, the center frequency number $C(f_{fi})$ for the formant of i=1 and the level data Li(dB) are initially read from the tables 18 and 20 in response to the output (X=1) of the counter 19. The harmonic frequency number C(k) and the harmonic intermediate frequency number C(INTER)k for the first harmonic frequency (i.e. the fundamental frequency)$f_0$ of k=1 are read from the tables 21 and 23.

Comparison for detecting "$f_{fi} \geqq f_0$?" i.e., whether the formant center frequency $f_{fi}$ is equal to or larger than the fundamental frequency $f_0$ of the depressed key, is performed by the subtractor 25. If the answer is YES, the output (B≧A) of the subtractor 25 is "1" whereas if the answer is NO, the output is "0". Since the center frequency number $C(f_{fi})$ of the formant of i=1 is initially read from the table 18, the above described comparison is made with respect to the formant center frequency $f_{fi}$ of the formant of i=1. When the answer is YES, the search instruction signal x1 supplied from the output (B≧A) of the subtractor 25 to the control circuit 26 through the line 27 is turned to "1". This is a signal for instructing search for a harmonic frequency $kf_0$ which is nearest to the center frequency $f_{fi}$ of the i-th formant for the reason that the formant center frequency $f_{fi}$ is higher than the fundamental frequency $f_0$ of the depressed key so that a component by this i-th formant should be included in the tone signal corresponding to the depressed key. When the answer is NO, the search instruction signal x1 is "0" and no search is instructed. This is because the formant center frequency $f_{fi}$ is lower than the fundamental frequency $f_0$ of the depressed key so that a component by the i-th formant need not be included in the tone signal corresponding to the depressed key. When the answer is NO, all bits of the level data $(L+l)_i$ are compulsorily turned to "1" through the OR gate group 35 by the signal "0" on the line 27 whereby the level is reduced to 0 and the i-th formant is cancelled ($(L+l)i \rightarrow \infty$ in FIG. 10). "To RAM 15" in FIG. 10 means loading of data $\omega_{ci}$, $\omega_{mi}$ and $(L+l)i$ which is then being outputted to the buffer RAM 15 (FIG. 6). When "$f_{fi} \geqq f_0$?" is NO, the data $(L+l)i$ of the amount of attenuation $\infty$ dB (level 0) is stored in the RAM 15 and, accordingly, the i-th formant corresponding to the data $(L+l)i$ of the level 0 is not generated when computation is performed in the FM computation circuit 16 later.

In a step $$\text{"}f_{fi} \leqq \frac{kf_0 + (k+1)f_0}{2} \text{?"},$$

whether or not conditions of the formula (6) are satisfied with respect to the harmonic order k which is presently designated by the output Y of the counter 22 is judged. As was previously described, this judgement is made by the comparator 24. When the answer is NO, judgement of "k=M?" is made. If the answer of "k=M?" is NO, 1 is added to the order k(i.e. $k+1 \rightarrow K$) and thereafter a next harmonic is designated and the above described judgement by the comparator 24 is resumed. When the answer to $$\text{"}f_{fi} \leqq \frac{kf_0 + (k+1)f_0}{2} \text{?"}$$

is YES, this means that the harmonic frequency $kf_0$ corresponding to the present harmonic order k is the nearest harmonic frequency to the formant center frequency $f_{fi}$. The output ($A \leqq B$) of the comparator 24, i.e., the nearest harmonic detection signal yl thereupon is turned to "1". The level corrected level data $(L+l)$ i which has been computed in the channel including the subtractor 31 through the adder 34 in accordance with the then available harmonic frequency number $C(kf_0)$ is loaded in the buffer RAM 15 with the frequency data $\omega_{ci}$ and $\omega_{mi}$ (To RAM 15).

By completion of the processing of "To RAM 15," the computation concerning the i-th formant is completed and the step proceeds to "i=N?". If the answer is NO, a process of "$i+1 \rightarrow i$" is performed and a next formant is designated. When the value of i has been changed and a next formant has been designated, the processing returns to "$f_{fi} \geqq f_0$?" again, the same processing as was previously described being repeated. The processing proceeds to "i=N?" also and a next formant is designated when the order k has reached the maximum value M (k=M? is YES") before the above described judgement $$\text{"}f_{fi} \leqq \frac{kf_0 + (k+1)f_0}{2} \text{?"}$$

becomes YES. As the value of i gradually increases and "i=N?" at last becomes YES, computation concerning all formants is completed.

Figure 11:
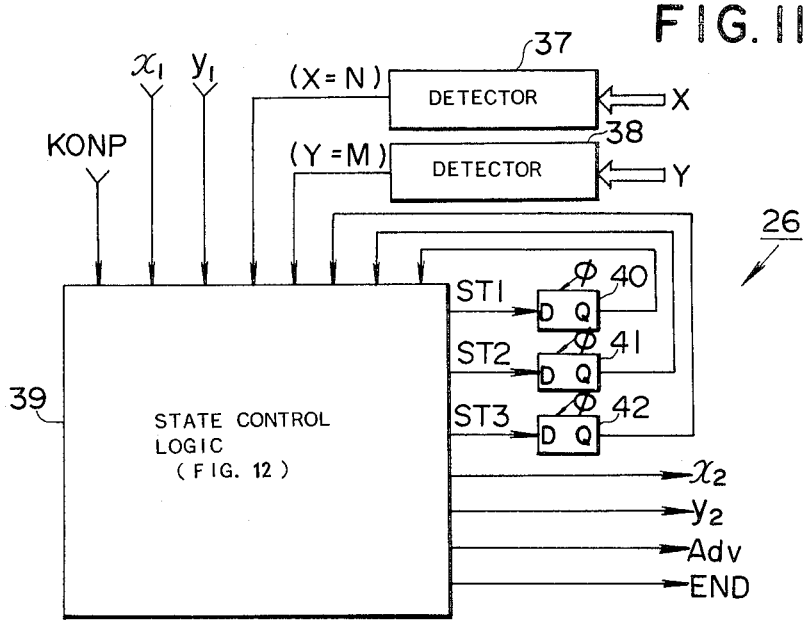
FIG. 11 is a block diagram showing a structure of a control circuit appearing in FIG. 8.

The sequential operation shown in FIG. 10 is controlled by the control circuit 26 which has a structure as shown in FIG. 11. In FIG. 11, the control circuit 26 includes a detector 37 for detecting whether the output X of the formant counter 19 (FIG. 8) has reached a total number N of formants, a detector 38 for detecting whether or not the output Y of the harmonic counter 22 (FIG. 8) has reached the highest harmonic order M (Y=M or not) and a state control logic 39 which receives outputs of these detectors 37 and 38, the search instruction signal x1 from the subtractor 25, the nearest harmonic detection signal y1, the key-on pulse KONP and state signals $ST_1$, $ST_2$ and $ST_3$ which are delayed by delay flip-flop 40, 41 and 42 by one bit time.

Figure 12:
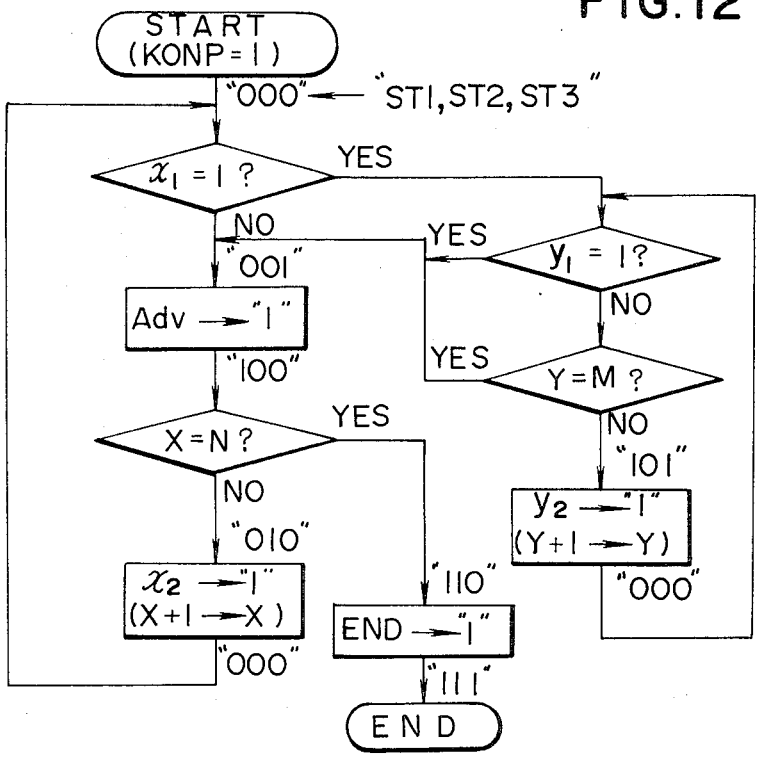
FIG. 12 is a flow chart showing an operation of a state control logic of FIG. 11.

The state control logic 39 is so constructed that it changes states of the state signals $ST_1$, $ST_2$ and $ST_3$ in the order shown in FIG. 12 in response to the input signals x1, y1 etc. and outputs a harmonic order increase signal y2, a formant order increase signal x2, an advance signal AdV and a computation end signal END. When the key-on pulse KONP is provided, the state conrol logic 39 resets the state signals $ST_1$, $ST_2$ and $ST_3$ to "000" and starts the control operation. In this state, whether the search instruction signal x1 is "1" or not is examined (x1=1?). Thereupon, the judgement of "$f_{fi} \geqq f_0$?" in FIG. 10 is implemented. If the answer is YES, whether the nearest harmonic detection signal y1 is "1" or not is examined (Y1=1?). If the answer to "y1=1?" is NO, whether "Y=M" is YES or not is examined on the basis of the output of the detector 38. Since, as was described previously, the signal Y initially is set to "1", "Y"=M?" is NO. The state of the state signals $ST_1$, $ST_2$, and $ST_3$ are changed to "101" to generate the harmonic order increase signal y2(y2→"1") and then the state signals $ST_1$, $ST_2$ and $ST_3$ are restored to "000".

The harmonic order increase signal y2 produced by the control circuit 26 is applied to a count input of the harmonic counter 22 (FIG. 8). With turning of the signal y2 to "1", the contents Y of the harmonic counter 22 are counted up by 1 to increase the harmonic order k designated by Y by 1. If, for example, the signal Y2 initially becomes "1", the contents Y become 2 and the harmonic frequency number C(k) and the harmonic intermediate frequency number C(INTER)k corresponding to k=2, i.e., the second harmonic frequency $2f_0$, are read from the tables 21 and 23. The value of C(INTER)k applied to the B input of the comparator 24 thereby changes and comparison as to whether or not the second harmonic frequency $2f_0$ is nearest to the formant center frequency $f_{fi}$ is made.

In the state control logic 39 in the control circuit 26, whether or not the nearest harmonic detection signal y1 provided by the comparator 24 has become "1" is reexamined. If the result is NO, the harmonic order increase signal y2 is again changed to "1" upon confirming that "Y=M" is NO. The contents Y of the harmonic counter 22 (FIG. 8) thereby are further counted up by 1 and the harmonic order k increases by 1 (e.g. k=3).

The harmonic frequency increase signal y2 is repeatedly produced in the above described manner, causing the contents Y of the harmonic counter 22 to be sequentially counted up and the harmonic order k to increase from the initial value 1 to 2, 3, 4 . . . successively. Accordingly, the comparator 24 (FIG. 8) performs comparison to detect whether the formula (6) (i.e., $$f_{fi} \leqq \frac{kf_0 + (k+1)f_0}{2} \text{?}$$

in FIG. 10) is satisfied or not. When the output Y of the harmonic counter 22 designates the order k of the harmonic frequency $kf_0$ which is nearest to the formant center frequency $f_{fi}$, the condition set in the comparator 24 is satisfied and the nearest harmonic detection signal y1 becomes "1".

Upon confirming that the signal y1 has become "1", the state control logic 39 in the control circuit 26 changes the states of the state signals $ST_1$, $ST_2$ and $ST_3$ to "001", outputs the advance signal Adv (i.e., Adv→"1") and thereafter changes states of the state signals $ST_1$, $ST_2$ and $ST_3$ to "100". The advance signal Adv therefore is produced 1 bit time after the detection of the nearest harmonic and is cancelled 1 bit time later. In other words, the advance signal Adv stays "1" during one cycle of the clock pulse $\phi$.

Figure 9:
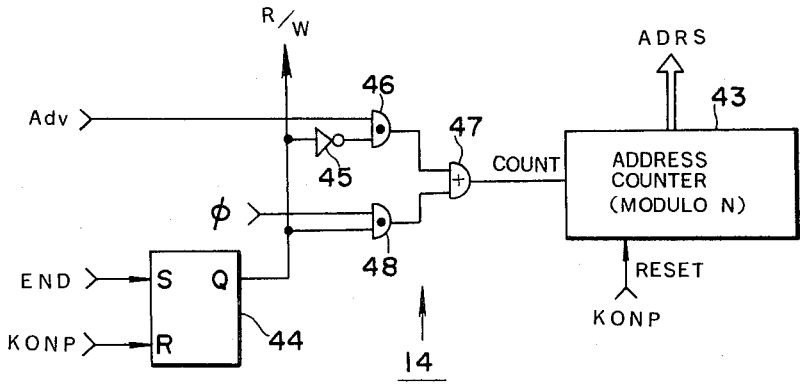
FIG. 9 is a block diagram showing, in detail, an example of an address generator appearing in FIG. 6.

The advance signal Adv is supplied to the address generator 14 (FIG. 6, FIG. 9). Referring to FIG. 9, the address generator 14 includes an address counter 43 of mudulo N corresponding to the largest number N of the formants and a flip-flop 44. The counter 43 and the flip-flop 44 are reset by the key-on pulse KONP. Accordingly, the flip-flop 44 is in a reset state and its output (Q) is maintained at "0" while the parameter computation circuit 13 (FIG. 8) is performing the computation processing. The output "0" of the flip-flop 44 is inverted by an inverter 45 and an inverted signal 1 is applied to an AND gate 46 to enable it. The output (Q) of the flip-flop 44 is applied also to a read-write control input of the buffer RAM 15 (FIG. 6) as a read-write control signal R/W. When this output (Q) of the flip-flop 44, i.e. the read-write control signal R/W is "0," the buffer RAM 15 is set at a write mode whereas when the signal R/W is "1", the buffer RAM 15 is set at a read-mode. Accordingly, the buffer RAM 15 is set in a write mode while the parameter computation circuit 13 is performing the computation processing in an initial stage of the key depression. The AND gate 46 (FIG. 9) is enabled during the write mode so that the advance signal Adv is gated out of the AND gate 46 and is applied to a count input of the counter 43. An output ADRS of the counter 43 is applied to an address input of the buffer RAM 15 (FIG. 6).

In a state wherein the address counter 43 is reset by the key-on pulse KONP, the output ADRS of the address counter 43 designates an address 0. Accordingly, the data $\omega_{ci}$,$\omega_{mi}$ and $(L+1)_i$ initially are written in the address 0 of the buffer RAM 15.

Immediately before generation of the advance signal Adv, i.e., when the nearest harmonic detection signal y1 has become "1", the output Y representing the order k of the harmonic frequency $kf_0$ which is nearest to the formant center frequency $f_{fi}$ (where i is 1) is provided by the harmonic counter 22 (FIG. 8), the data $\omega_{ci}$ representing the nearest harmonic frequency $kf_0$ and the level data $(L\pm1)i$ which has been corrected in the level in accordance with the difference $\alpha_f$ between the nearest harmonic frequency $kf_0$ and the formant center frequency $f_{fi}$ are being outputted by the parameter computation circuit 13 (FIG. 8) and the data $\omega_{ci}$, $(L+1)i$ and $\omega_{mi}$ are written in the address 0 of the buffer RAM 15. As the address counter 43 is counted up by 1 by generation of the advance signal Adv, a next address (1) of the buffer RAM 15 is designated as a write address by the output ADRS. Accordingly, the data $\omega_{ci}$, $(L+1)i$ and $\omega_{mi}$ concerning the nearest harmonic frequency $kf_0$ which was written in the preceding address (0) are held in the preceding address (0) immediately before generation of the advance signal Adv.

After generation of the advance signal Adv, states of the state signals $ST_1$, $ST_2$ and $ST_3$ are changed to "010" upon confirming that "X=N" is not detected by the detector 37 (FIG. 11) (i.e., "X=N?" in FIG. 12 is NO), and the formant order increase signal x2 is generated (x2→"1"). Thereafter, states of the state signals $ST_1$, $ST_2$ and $ST_3$ are restored to "000" and the judgement of "x1=1?" is resumed.

The formant order increase signal x2 outputted by the control circuit 26 is applied to a count input of the formant counter 19 (FIG. 8). When this signal x2 is turned to "1", the contents x of the counter 19 are countered up by 1 thereby increasing the order i of the formant designated by x by 1. When for example, the signal x2 first becomes "1", the output x of the counter 19 is turned to "2" and the frequency number $C(f_{fi})$ and the level data Li(dB) corresponding to the center frequency $f_{f2}$ of a formant of i=2 i.e., the second formant, are read from the tables 18 and 20. The value of $C(f_{fi}-f_0)$ applied to the A input of the comparator 24 (FIG. 8) is thereby changed and comparison for detecting a harmonic frequency $kf_0$ nearest to the center frequency $f_{f2}$ of the second (i=2) formant is made. In the same manner as was previously described, the harmonic order increase signal y2 is repeatedly generated (y2→"1") until "y1=1?" becomes YES, i.e., until the nearest harmonic detection signal y1 is generated resulting in further increase of the contents Y of the harmonic counter 22.

When the nearest harmonic detection signal y1 has become "1", the advance signal Adv is generated in the same manner as was previously described and the address counter 43 (FIG. 9) is further counted up by 1 whereby the data $\omega_{ci}$, $(L+1)_i$ and $\omega_{mi}$ of the harmonic frequency $kf_0$ which is nearest to the formant center frequency $f_{f2}$ at the time of i=2 are loaded in the address of the buffer RAM 15 in a state before the address is advanced by 1 address by the advance signal Adv.

As described in the foregoing, the formant order increase signal x2 is repeatedly generated (x2→"1") until "x=N?" becomes YES and the harmonic frequency $kf_0$ nearest to the center frequency $f_{fi}$ of each formant thereby is detected at each formant (i=1, 2, . . . N) and the data $\omega_{ci}$, $(L+1)_i$ and $\omega_{mi}$ corresponding to the detected harmonic frequency $kf_0$ are sequentially loaded in the buffer RAM 15. Since in this example data representing the fundamental frequency of the depressed key is employed as the frequency data $\omega_{mi}$ corresponding to a modulating wave, this data $\omega_{mi}$ does not change despite the change of i.

When the advance signal Adv is generated in a state wherein the output X of the formant counter 19 has reached the maximum number N and the states of the state signals $ST_1$ through $ST_3$ have become "100," "X=N?" in FIG. 12 becomes YES. The states of the state signals $ST_1$ through $ST_3$ thereby are changed to "110". The states of the state signals $ST_1$ through $ST_3$ thereafter are changed to "111" and the computation end signal END is cancelled. Thus, the computation processing is completed.

The computation end signal END is applied to the set input (S) of the flip-flop 44 (FIG. 9) of the address generator 14. The flip-flop 44 is thereby set and the read-write control signal R/W is turned to "1". Accordingly, the buffer RAM 15 is set to a read mode. The output "1" of the flip-flop 44 is applied also to an AND gate 48 (FIG. 9) and a clock pulse $\phi$ is selected by the AND gate 48 and applied to the count input of the address counter 43 through the OR gate 47. On the other hand, the output of the inverter 45 is turned to "0" and the AND gate 46 therefore is disabled. It is when the computation of parameters $\omega_{ci}$, $(L+1)_i$ and $\omega_{mi}$ concerning all formants has been completed that the computation end signal END is generated, so that results of the computation have all been loaded in all of the addresses (N) of the buffer RAM 15.

When "x1=1?" (FIG. 12) is NO, the advance signal Adv is immediately generated (Adv→"1"). At this time, the output (B≧A) of the subtractor 25 (FIG. 8) is "0" and the level data $(L+1)_i$ outputted by the OR gate group 35 is all turned to "1" (level 0) by the signal "0" on the line 27. Accordingly, the level data $(L+1)_i$ representing the level 0 is loaded to the buffer RAM 15 together with the other data $\omega_{ci}$ and $\omega_{mi}$. The formant order increase signal x2 is thereafter generated (x2→"1") and the frequency number C ($f_{fi}$) representing the center frequency $f_{fi}$ of a next formant is read from the table 18. As the order i increases, the center frequency $f_{fi}$ increases until the output (B≧A) of the subtractor 25 becomes "1" and the search instruction signal x1 is turned to "1".

If the output Y of the harmonic counter 22 has reached the maximum value M before the nearest harmonic frequency $kf_0$ has been detected, "Y=M?" (FIG. 12) becomes YES and the advance signal Adv is produced (Adv→"1"). The fact that "Y=M?" has become YES without detection of the production of the nearest harmonic frequency detection signal Y1 signifies that the formant center frequency $f_{fi}$ is much higher than the harmonic frequency $Mf_0$ of the highest order. K=M. Accordingly, the data C(Δf) representing the frequency difference Δf provided by the subtractor 31 through the absolute value circuit 32 (FIG. 8) is of a fairly large value at this time and the level correction amount data $l_i$(dB) read from the formant correction level table 33 exhibits an infinite amount of attenuation and the level data $(L+1)_i$ becomes all "1" representing an infinite amount of attenuation (level 0). It will be understood that although the data $\omega_{ci}$, $(L=1)_i$ and $\omega_{mi}$ computed on the basis of the harmonic frequency $Mf_0$ of the heighest order (k=M) are loaded in the buffer memory RAM 15 by the generation of the advance signal Adv, no formant corresponding to this frequency is formed, for its level data $(L+1)_i$ is 0.

Figure 13:
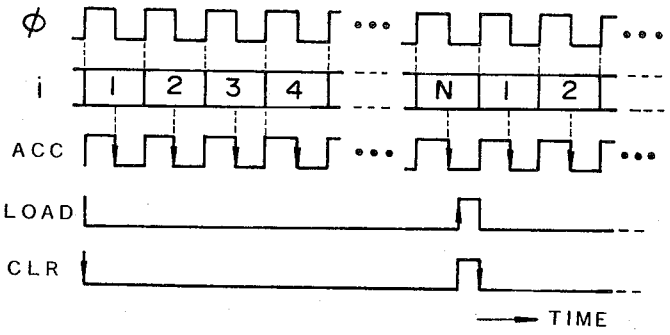
FIG. 13 is a timing chart for explaining a time division computation timing in an FM computation circuit appearing in FIG. 6.

Forming of a formant by the frequency modulation computation in the FM computation circuit 16 will now be described. Since the address counter 43 shown in FIG. 9 is of a modulo N, the output ADRS of the counter 43 returns to its initial value (i.e. address 0) upon receipt by the address counter 43 of the advance signal Adv when the output x of the formant counter 19 (FIG. 8) is N. The flip-flop 44 (FIG. 9) is set by the computation end signal END which is generated immediately thereafter and the buffer RAM 15 is thereby switched to a read mode, starting reading out of the data $\omega_{ci}$, $\omega_{mi}$ and $(L+1)_i$ (I=1) stored in the address 0 thereof. Since the address counter 43 thereafter is sequentially counted up by the clock pulse $\phi$ which is provided through the AND gate 48 and the OR gate 47 (FIG. 9), data $\omega_{ci}$, $\omega_{mi}$ and $(L+1)_i$ of the respective formants (i=1, 2, . . . N) stored in N addresses (from address 0 to address N-1) of the buffer RAM 15 are sequentially and repeatedly read out. Relationship between the clock pulse $\phi$ and the respective formant (i=1, 2, 3 . . . N) for which the data $\omega_{ci}$, $\omega_{mi}$ and $(L+1)_i$ are read out on a time shared basis in response to this clock pulse $\phi$ is shown in FIG. 13.

Referring to FIG. 6, the center frequency data (carrier data) $\omega_{ci}$ concerning the respective formants (i=1, 2, 3, . . . N) and the fundamental frequency data modulating wave data) $\omega_{mi}$ of the depressed key read from the buffer RAM 15 on a time shared basis are applied to accumulators 49 and 50 where data of the same order is cumulatively added together. The accumulator 49 has an adder 51 and a shift register 52 of an N-stage which is shift-controlled by the clock pulse $\phi$. The accumulator 49 is capable of cumulatively adding the data $\omega_{ci}$ of the respective formants (i=1, 2, 3 . . . N) on a time shared basis. Timing (i.e. the order i) of the accumulated value $q\cdot\omega_{ci}$ outputted from the shift register 52 is synchronized with timing (the order i) of the data $\omega_{ci}$ supplied to the adder 51 from the buffer RAM 15, so that the data $\omega_{ci}$ of the same order i is repeatedly added and the accumulated value $q\cdot\omega_{ci}$ is outputted on a time shared basis at each order. q is an integer representing times of the repeated addition and a variable changing 1, 2, 3 . . . with lapse of time. The accumulator 50 includes, as the accumulator 49, an adder and a shift register of N stages. The accumulator 50 cumulatively adds the data $\omega_{mi}$ corresponding to the respective orders i on a time shared basis and outputs accumulated values $q\cdot\omega_{mi}$ corresponding to the respective orders on a time shared basis..

As is well known, the accumulators 49 and 50 respectively have modulo corresponding to phase angle $2\pi$ and, each time the accumulated value $q\cdot\omega_{ci}$ or $q\cdot\omega_{mi}$ has reached or exceeded the modulo number, subtract the modulo number from the value $q\cdot\omega_{ci}$ or $q\cdot\omega_{mi}$. Accordingly, the accumulated values $q\cdot\omega_{ci}$ and $q\cdot\omega_{mi}$ are functions which repeat increase up to the modulo number. The frequency of repetition is equivalent to the harmonic frequency $kf_0$ represented by the data $\omega_{ci}$ or the fundamental $f_0$ of the depressed key represented by the data $\omega_{mi}$ which is nearest to the formant center frequency $f_{fi}$.

The data $q\cdot\omega_{mi}$ outputted by the accumulator 50 is applied to an address input of a sinusoidal wave table 53. A sinusoidal wave amplitude value sin $q\cdot\omega_{mi}$ is read from the table 53 in response to the data $q\cdot\omega_{mi}$ which is utilized as phase angle information. This sinusoidal wave amplitude value sin $q\cdot\omega_{mi}$ corresponds to the modulating wave sin $\omega_{mi}t$ in the formula (3). The modulating wave signal sin $q\cdot\omega_{mi}$ read from the table 53 is applied to a multiplier 54 where it is multiplied with a modulation index $I_i$ read from an index ROM 55.

The voice code VC from the voice selector 12 and the address signal ADRS from the address generator 14 (the address counter 43 in FIG. 9) are applied to the index ROM 55. The index ROM 55 prestores modulation indices $I_i$ for determining spectrum envelopes of N formants (i=1, 2, . . . N) for each of tone colors (fixed formants) selectable by the voice selector 12. In the index ROM 55, a set of modulation indices $I_i$ (i=1, 2, . . . N) consisting of N data corresponding to a desired tone color is selected in accordance with the voice code VC and the modulation indices $I_i$ of the respective orders (the sme orders i as the data $\omega_{ci}$, $\omega_{mi}$ and $(L+1)_i$) are read out from among the set of modulation indices on a time shared basis in synchronism with reading of the buffer RAM 15 and in response to the address signal ADRS. Accordingly, a modulation index and a modulating wave signal of the same order are multiplied with each other.

In an adder 56, the data $q\cdot\omega_{ci}$ (corresponding to the phase angle $\omega_{ci}t$ of a carrier in the formula (3)) outputted from the accumulator 49 and the modulating wave signal $I_i$ sin $q \cdot \omega_{mi}$ outputted by the multiplier 54 are added together. The output ($q \cdot \omega_{ci} + I_i$ sin $q \cdot \omega_{mi}$) of the adder 54 is supplied to an address input of a sinusoidal wave table 57 and a sinusoidal wave amplitude value sin ($q \cdot \omega_{ci} + I_i$ sin $q \cdot \omega_{mi}$) is read from the table 57 in response to the output of the adder 56 which is utilized as phase information. In the present embodiment, the sinusoidal wave table 57 stores sinusoidal wave amplitude values in logarithm for convenience of computation to be held in a post stage.

In the above described manner, the signal sin($q \cdot \omega_{ci} + I_i$ sin $q \cdot \omega_{mi}$) is obtained in a logarithmic value by frequency modulating a carrier (having the harmonic frequency $f_{fi}$ represented by the data $\omega_{ci}$) by a modulating wave (having the fundamental frequency $f_0$ of the depressed key represented by the data $\omega_{mi}$) with the modulation index $I_i$.

An adder 58 is a circuit for adding the frequency modulated signal log sin($q \cdot \omega_{ci} + I_i$sin $q \cdot \omega_{mi}$) in a logarithmic value outputted by the sinusoidal wave table 57 and an amplitude coefficient log $A_i$ in a logarithmic value together to multiply the frequency modulated signal sin($q \cdot \omega_{ci} + I_i$ sin $q \cdot \omega_{mi}$) by the amplitude coefficient $A_i$. Since addition of logarithmic values corresponds to multiplication of linear values, the multiplication by the amplitude coefficient $A_i$ can be carried out by the adder 58 which is of a simple construction.

An envelope generator 59 prestores amplitude envelope signals from starting of sounding of a tone to extinguishing of the tone with respect to respective tone colors. An amplitude envelope signal corresponding to a desired tone color is selected by the voice code VC provided by the voice selector 12. The envelope generator 59 includes a read control circuit. When the key-on pulse KONP is provided, the read control circuit is triggered and an amplitude envelope signal selected in the above described manner is read out with lapse of time. The amplitude envelope signal log D(t) read from the envelope generator 59 is also expressed in logarithm.

An adder 60 adds the level data (L+1)i corresponding to the respective formants (i=1, 2 . . . N) read from the buffer RAM 15 on a time shared basis and the amplitude envelope signal log D(t) together to obtain the amplitude coefficients log Ai corresponding to the respective formants (i=1, 2 . . . N). Since the level data (L+1)i represents an amount of attenuation, the amplitude coefficient log Ai is expressed in logarithm. Accordingly, the addition in the adder 60 is equivalent to multiplication of the level corrected formant level data by the amplitude envelope signal D(t). Therefore, the amplitude coefficient Ai (i=1, 2, . . . N) equivalent to the amplitude coefficient A in the formula (2) or (2') is provided by the adder 60 in logarithm. This amplitude coefficient log Ai outputted by the adder 60 is supplied to the adder 58.

In the above described manner, the frequency modulated signal Ai sin ($q \cdot \omega_{ci}$+Ii sin $q \cdot \omega_{mi}$) which has been corrected in its level by the amplitude coefficient Ai which has been corrected in its level in accordance with the shift amount of the formant center frequency ($\omega_{ci}$) is outputted in a logalithmic value by the adder 58. This frequency modulated signal log Ai sin($w \cdot \omega_{ci}$+Ii sin $q \cdot \omega_{mi}$) in logarithm is converted to a linear value by a logarithm-linear conversion circuit 61 and thereafter is applied to an accumulator 62.

The accumulator 62 is provided for summing, at each waveform amplitude sampling time, the frequency modulated signal Ai sin ($q \cdot \omega_{ci}$+Ii sin $q \cdot \omega_{mi}$) for the respective formants (i=1, 2 . . . N) produced on a time shared basis. The clock pulse $\phi$ is applied to the accumulator 62 as a signal ACC representing timing of addition. As shown in FIG. 13, at each fall of the clock pulse $\phi$, i.e., at each intermediate timing of time division time slots of the respective formants (i=1, 2, 3 . . . N), the accumulator 62 cumulatively adds the frequency modulated signal Ai sin ($q \cdot \omega_{ci}$+Ii sin $q \cdot \omega_{mi}$) of the respective formants. The output of the accumulator 62 is applied to a register 63. A load control signal LOAD of the register 63 is generated, as shown in FIG. 13, in a latter half of a time slot for the N-th formant with a slight delay to the fall of the clock pulse $\phi$. The output of the accumulator 62 is loaded in the register 63 at a rise of this load signal LOAD. A clear control signal CLR of the accumulator 62 is generated simultaneously with the load control signal LOAD as shown in FIG. 13, and the accumulator 13 so constructed that it is cleared at the fall of this clear control signal CLR. Accordingly, when the frequency modulated signals (instantaneous amplitude values) Ai sin ($q \cdot \omega_{ci}$+Ii sin $q \cdot \omega_{mi}$) corresponding to the first formant (i=1) through the N-th formant (i=N) have all been cumulatively added in the accumulator 62, the result of the addition is loaded in the register 63. The contents of the accumulator 62 are cleared immediately thereafter. A sum of amplitudes of the frequency modulated signals for all of the formants (i=1, 2, . . . N) in one sampling time $$\sum_{i=1}^{N} Ai \sin(q \cdot \omega_{ci} + Ii \sin q \cdot \omega_{mi})$$

is outputted from the register 63. This sum is equivalent to the formula (3). The output of the register 63 is converted to an analog signal (equivalent ot the tone signal e(t) in the formula (3)) by a digital-to-analog converter 64 and a tone signal is sounded through a sound system 65.

Figure 14:
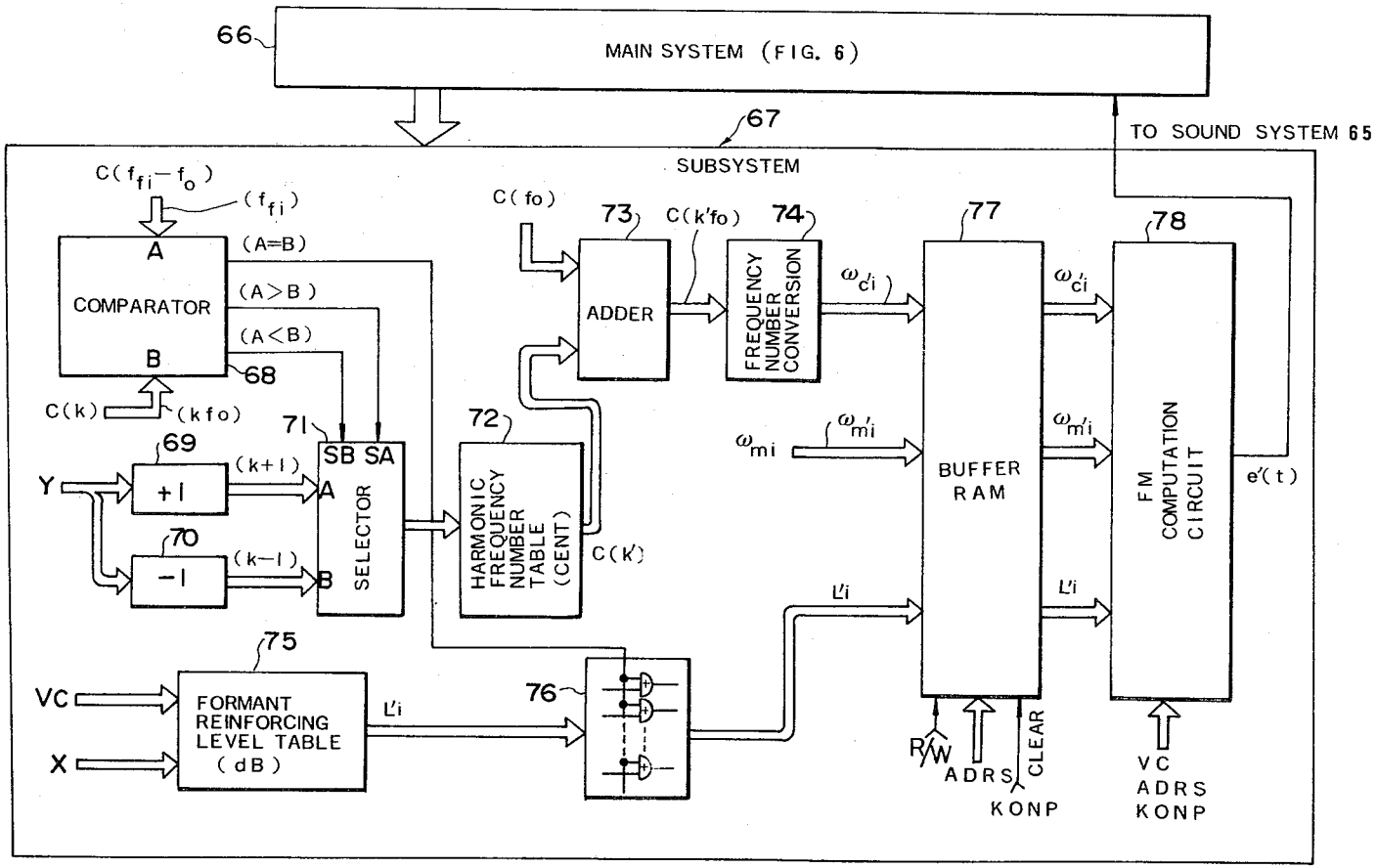
FIG. 14 is a block diagram showing an essential portion of another embodiment of the invention for carrying out the solution shown in FIGS. 4(*a*) and 4(*b*)

An embodiment in which an improvement has been made in accordance with "Counterplan I" will now be described with reference To FIG. 14. In FIG. 14, a main system 66 is entirely of the same construction as the electronic music instrument shown in FIG. 6 (from the keyboard 10 to the sound system 65). By adding a subsystem 67 to the construction of FIG. 6, the improvement according to the Couterplan I is achieved. The Counterplan I is to make another formant using as a central component the harmonic frequency $(k+1)f_0$ or $(k-1)f_0$ shown by chain-and-dot lines in FIGS. 4(*a*) and 4(*b*) which is adjacent to the harmonic frequency $kf_0$ nearest to the format center frequency $f_{fi}$. The subsystem 67 is provided for forming such other formant as shown by chain-and-dot lines in FIGS. 4(*a*) or 4(*b*).

In the subsustem 67, the frequency number ($fC_{fi} - f_0$) outputted by the subtractor 25(FIG. 8) in the parameter computation circuit 13 of the main system 66 is applied to an A input of a comparator 68 and the harmonic frequency number C(k) outputted by the harmoic frequency number table 21(FIG. 8) is applied to a B input of the comparator 68. The frequency number $C(f_{fi} - f_0)$ represents a cent value of the formant center frequency $f_{fi}$ with the fundamental frequency $f_0$ being taken as a reference (0 cent) whereas the frequency number C(k) represents a cent value of the harmonic frequency $kf_0$ with the fundamental frequency $f_0$ being taken as a reference (0 cent). Accordingly, the formant center frequency $f_{fi}$ and the harmonic frequency $kf_0$ are compared in magnitude in the comparator 68. When the formant center frequency $f_{fi}$ is equal to the harmonic frequency $kf_0$, the output (A=B) of the comparator 68 is "1". When the formant center frequency $f_{fi}$ is higher than the harmonic frequency $kf_0$(i.e., in the case of FIG. 4(*a*)), the output (A>B) of the comparator 68 is "1". When the formant center frequency $f_{fi}$ is lower than the harmonic frequency $kf_0$(i.e., in the case of FIG. 4(*b*)), the output (A<B) of the comparator 68 is "1".

On the other hand, the output Y of the harmonic counter 22(FIG. 8) is applied to an adder 69 and a subtractor 70. In the adder 69, 1 is added to the value Y whereas in the subtractor 70, 1 is subtracted from the value Y in the subtractor 70. When the output (A>B) of the comparator 68 is "1", an output (k+1) of the adder 69 is selected by a slector 71. When the output (A<B) of the comparator 68 is "1", an output (k−1) of the subtractor 70 is selected by the selector 71. The harmonic frequency number table 72 prestores, as the harmonic frequency number table 21 in FIG. 8, cent values of the respective harmonic frequencies with the fundamental frequency (the first harmonic frequency)$f_0$ being taken as a reference (0 cent) and provides a harmonic frequency number C(k') in response to the data (k+1) or (k−1) selected by the selector 71. When the format center frequency $f_{fi}$ is higher than the harmonic frequency $kf_0$, i.e. $f_{fi}>kf_0$(FIG. 4(*a*)), the harmonic frequency number table 72 produces, in response to the data (k+1), harmonic frequency number C(k') representing a harmonic frequency $(k+1)f_0$ whose harmonic order is higher than the harmonic order k of the output Y of the harmonic counter 22(FIG. 8) by one order. When the formant center frequency $f_{fi}$ is lower than the harmonic frequency $f_0$ i.e., $f_{fi}<kf_0$ (FIG. 4(*b*), the table 72 produces a harmonic frequency number C(k') representing a harmonic frequency $(k-1)f_0$ whose harmonic order is lower than the harmonic order k of the output Y by one order in response to the data (k−1).

The harmonic frequency number C(k') read from the table 72 is applied to an adder 73 in which it is added with the frequency number $C(f_0)$ of the depressed key supplied by the frequency number table 17(FIG. 8) of the main system 66. This adder 73, as the adder 28 in FIG. 8, is provided for converting the harmonic frequency number C(k') to a cent value with the frequency $f_{c2}$ of the lowest key C2 being taken as a reference. The harmonic frequency number $C(k'f_0)$ consisting of a corrected cent value outputted from the adder 73 is applied to a frequency number conversion circuit 74 in which it is converted to data $\omega_{c'i}$ for comparison with an ordinary freqeuncy. This data $\omega_{c'i}$ corresponds to the angular frequency $\omega_{c'i}$ of the carrier in the second term of the formula (4). As data $\omega_{m'i}$ corresponding to the angular frequency of the modulating wave, data $\omega_{mi}$ corresponding to the fundamental frequency $f_0$ of the depressed key provided by the frequency number conversion circuit 30 (FIG. 8) of the main system is employed.

A formant reinforcing level table 75 receives the output X of the formant counter 19(FIG. 8) of the main system 66. This table 75 prestores reinforcing levels for the respective formants (i=1, 2, 3 .... N) (for obtaining the level $l_0'$ of FIGS. 4(*a*) and 4(*b*)) in an amount of attenuation. A set of the reinforcing levels (i=1,2 ..... N) is selected in accordance with the voice code VC and reinforcing level data L'i for an i-th formant (i=1, 2 .... N) is read out among the selected set in response to the output X. The reinforcing level data L'i read from the table 75 is applied to a buffer RAM 77 through an OR gate group 76. The data $\omega_{m'i}$ and $\omega_{c'i}$ is applied also to the buffer RAM 77.

Figure 4A:
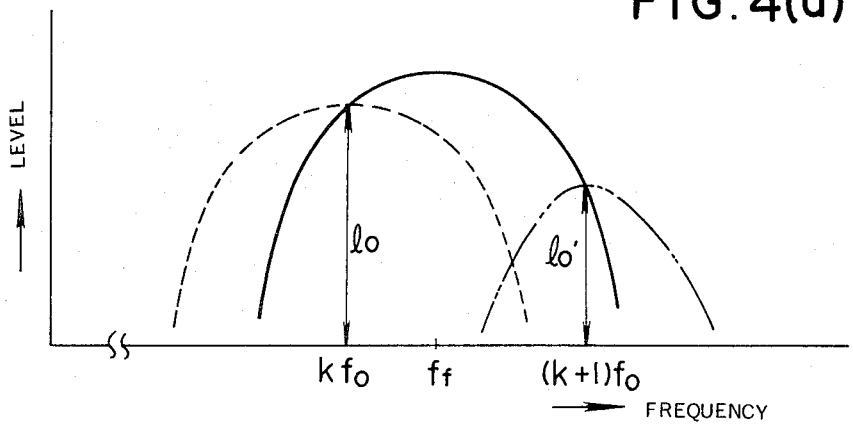
FIGS. 4(*a*) and 4(*b*) are spectrum envelope diagrams showing forming of another formant as a solution for correcting the error shown in FIG. 3.
Figure 4B:
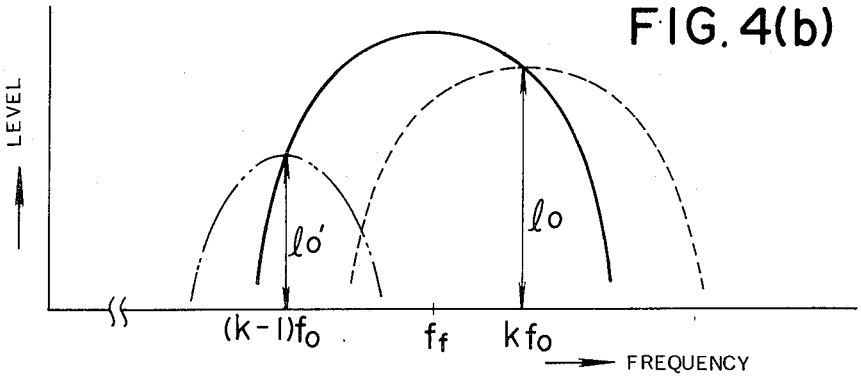

When the output (A=B) of the comparator 68 is "1" a signal "1" is applied to all of the OR gates in the OR gate group 76 thereby setting all bits of the reinforcing level data L'i compulsorily to "1" (the maximum amount of attenuation, i.e., level "0"). Accordingly, no other formant such as the one shown by the chain-and-dot line in FIG. 4 is formed in the subsystem 67 when $f_{fi}$ is equal to $kf_0$.

The buffer RAM 77 receives, as the buffer RAM 15 in FIG. 6, the address signal ADRS outputted by the address generator 14 and the read-write control signal R/W. The buffer RAM 77 therefore is controlled in writing and reading thereof in complete synchronism with the buffer RAM 15 (FIG. 6) in the main system 66.

The data $\omega_{c'i}$, $\omega_{m'i}$ and $L'_1$ read from the buffer RAM 77 in the read mode are applied to an FM computation circuit 78. This RM computation circuit 78 is of the same construction as the FM computation circuit 16(FIG. 6) of the main system 66, receiving the key-on pulse KONP, the voice code VC and the address signal ADRS from the main system 66. Accordingly, the FM computation circuit 78 implements the frequency modulation computation equivalent to the second term of the formula (4)

$$e'(t) = \sum_{i=1}^{N} A'_i \sin(q \cdot \omega_{c'i} + I'_i \sin q \cdot \omega_{m'i}) \text{ whereby}$$

another formant as shown by the chain-and-dot line in FIG. 4(*a*) and 4(*b*) is formed. The output signal e'(t) of the FM computation circuit 78 is applied to the main system 66 and mixed with the result of the frequency modulation computation equivalent to the first term of the formula (4) implemented in the main system 66, i.e., $$\sum_{i=1}^{N} Ai \sin(q \cdot \omega_{ci} + I_i \sin q \cdot \omega_{mi})$$

and thereafter is supplied to a sound system 65 (FIG. 6). An example in which an improvement has been made in accordance with the Counterplan II will now be desribed with reference to FIG. 15.

Figure 15:
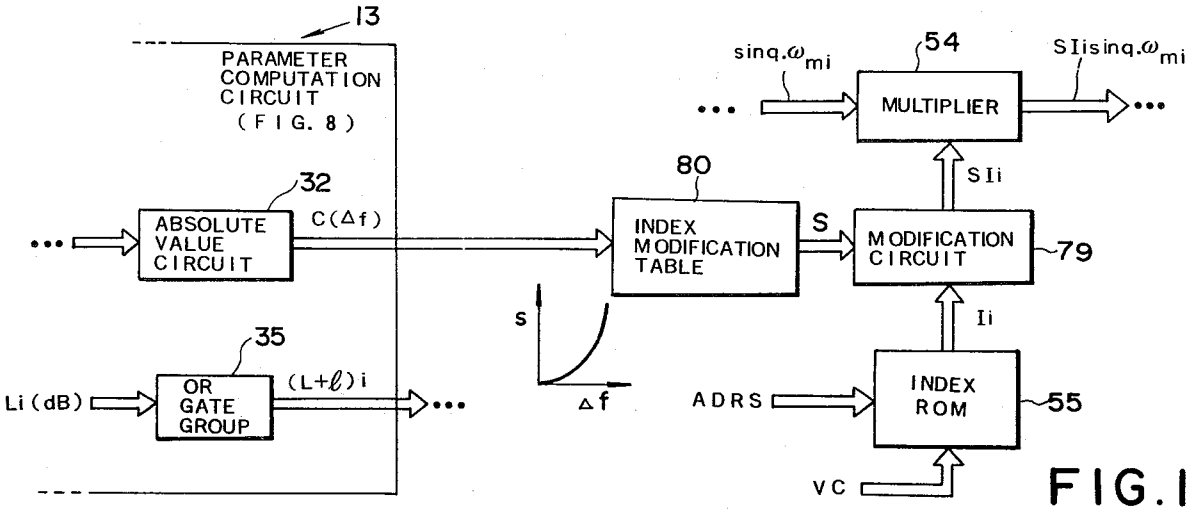
FIG. 15 is a block diagram showing an essential portion of still another embodiment of the invention for carrying out the solution shown in FIG. 5.

FIG. 15 is a diagram showing only modified portions of the embodiment shown in FIGS. 6 and 8. The rest of the circuit of the present embodiment is the same as the one shown in FIGS. 6, 8 and 9. In other words, the Counterplan II is achieved by applying the modification shown in FIG. 15 to the embodiment shown in FIGS. 6 and 8. The counterplan II is to flatten a spectrum envelope of a formant in proportion to increase of difference Δf between the formant center frequency $f_{fi}$ and the nearest harmonic frequency $kf_0$ as shown by broken lines in FIGS. 5(*a*) and 5(*b*) by controlling the modulation index $I_i$ in accordance with the difference Δf.

For realizing the Counterplan II, the formant corrected level table 33 and the adder 34 are removed from the parameter computation circuit 13 in FIG. 8 and the level data $L_i$(dB) read from the formant level table 20 is applied directly to the OR gate group 35. The level data $(L+1)_i$ utilized in the FM computation circuit 16 (FIG. 6), therefore, is the same as the data which is not corrected in level, i.e., the data Li(dB). There are also provided, as shown in FIG. 15, a modification circuit 79 between the index RQM 55 and the multiplier 54 in FIG. 6 and an index modification table 80. The frequency difference data C(Δf) provided by the absolute value circuit 32 in the parameter computation circuit 13(FIG. 8) is applied to the index modification table 80.

Relationship between the difference Δf from the formant center frequency $f_{fi}$ and a modified modulation index value S is prestored in the index modification table 80 and the modified modulation index value S is read out in response to the frequency difference data C(Δf). This modified value S is applied to the modification circuit 79 to modify the modulation index $I_i$ read from the index ROM 55. The modification circuit 79 may preferably be composed of a multiplier or an adder. It is so arranged in the present embodiment that the greater the frequency difference Δf, the greater is a value $SI_i$ of the modulation index $I_i$. The modulation index $SI_i$ modified by the modification circuit 79 is multiplied with the modulating wave sin $g \cdot \omega_{mi}$ in the multipler 54.

Figure 5A:
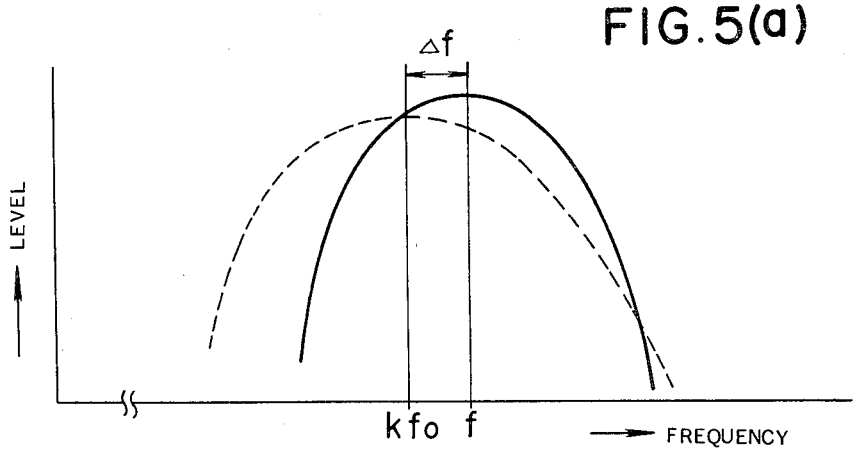
FIGS. 5(*a*) and 5(*b*) are spectrum envelope diagrams showing controlling of a modulation index as another solution for correcting the error shown in FIG. 3.
Figure 5B:
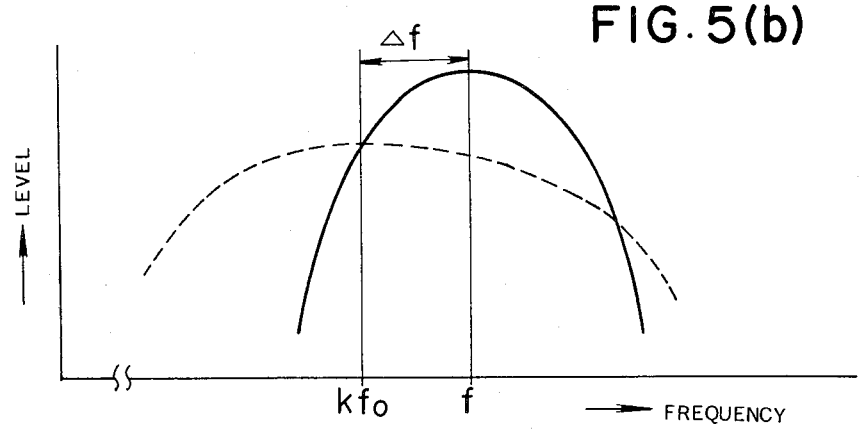

In the above described manner, the value of the modulation index $SI_i$ used in the computation in the FM computation circuit 16(FIG. 6) increases as the difference Δf between the harmonic frequency $kf_0$ used as a carrier ($\omega_{ci}$) in the computation in the FM computation circuit 16 and the original formant center frequency $f_{fi}$ increases and a resulting spectrum envelope of the formant is flattened as shown in FIGS. 5(*a*) and 5(*b*). The level correction by the Counterplan II is achieved in this manner.

Figure 16:
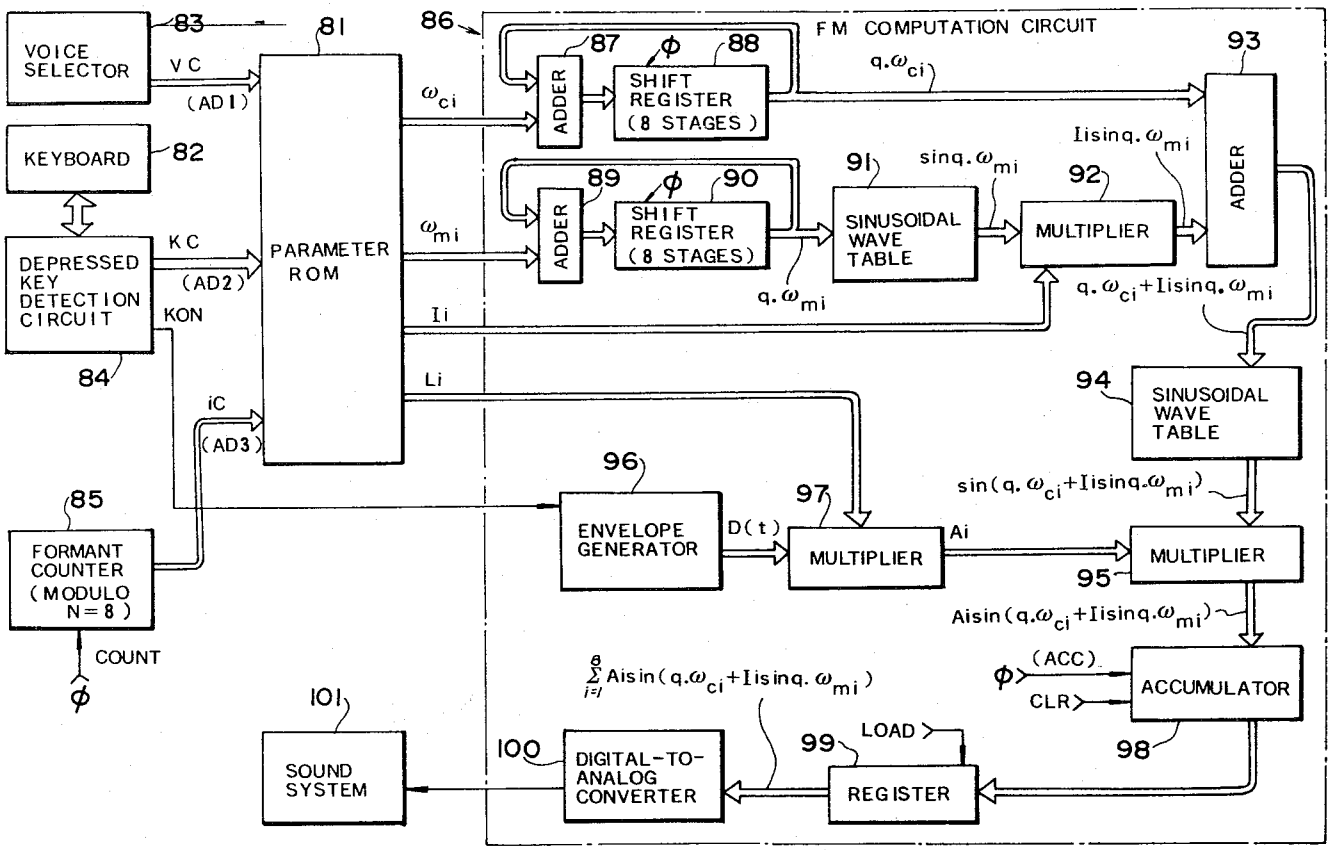
FIG. 16 is a block diagram showing an entire structure of another embodiment of the electronic musical instrument of the invention.

An embodiment in which the parameter computation circuit 13 (FIGS. 6 and 8) is replaced by a parameter ROM 81 will now be described with reference to FIG. 16.

The parameter ROM 81 consists of a read-only memory which prestores a set (i=1, 2, . . .N) of parameters (i.e., data $\omega_{ci}$ representing the frequency of a carrier, data $\omega_{mi}$ representing the frequency of a modulating wave, modulation index $I_i$ and the level data Li) required for the frequency modulation computation for forming of a formant with respect to each key of the keyboard and each selectable tone color (i.e., each fixed formant). If each data $\omega_{ci}$, $\omega_{mi}$, $I_i$ and $L_i$ constitutes one word, parameters ($\omega_{ci}$, $\omega_{mi}$, $I_i$ and $L_i$) for one formant consist of 4 words and a set (i=1, 2, 3 . . .N) of parameters ($\omega_{ci}$, $\omega_{mi}$, $I_i$ and $L_i$) corresponding to one key consists of 4.N words. If there are R keys in a keyboard 82 and T tone colors which are selectable by a voice selector 83, a capacity required for the parameter ROM 81 is 4·N·R·T words. If,for example, the number N of formants for forming one fixed formant is 8, the number R of the entire keys in the keyboard 82 is 25 and the number T of the tone colors is 4, the parameter ROM 81 is required to have a capacity of 4·N·R·T=4×8×25×4=3200 words.

An example of memory format of the parameter ROM 81 is shown in Table 4. According to this table, there are 4 tone colors of TA, TB, TC and TD, 25 keys ranging from a key $F_3$ to a key $F_5$ and 8 formants. The parameter ROM 81 has 4 large areas corresponding to the tone colors TA, TB, TC and TD. Each of the large areas consists of 25 middle areas corresponding to the keys $F_3$ to $F_5$ and each of the middle areas consists of 8 small areas corresponding to the respective orders i=1, 2 . . . 8 of each set of formants. Each of the small areas stores data $\omega_{ci}$, $\omega_{mi}$, $I_i$ and $L_i$ representing the four parameters $\omega_{ci}$, $\omega_{mi}$, $I_i$ and $L_i$ for forming the corresponding formant.

TABLE 4

| Parameter ROM 81 | | | | | | |
|---|---|---|---|---|---|---|
| Address | | | Stored data | | | |
| VC (tone color) | KC (key) | iC (i) | $\omega_{ci}$ | $\omega_{mi}$ | $I_i$ | $L_i$ |
| TA | $F_3$ | 1 | $\omega_{c1}$ | $\omega_{m1}$ | $I_1$ | $L_1$ |
| | | 2 | $\omega_{c2}$ | $\omega_{m2}$ | $I_2$ | $L_2$ |
| | | 3 | $\omega_{c3}$ | $\omega_{m3}$ | $I_3$ | $L_3$ |
| | | . | . | . | . | . |
| | | . | . | . | . | . |
| | | . | . | . | . | . |
| | | N=8 | $\omega_{c8}$ | $\omega_{m8}$ | $I_8$ | $L_8$ |
| | F#3 | | | | | |
| | . | | | | | |
| | . | | | | | |
| | $F_5$ | | | | | |
| TB | $F_3$ | | | | | |
| | . | | | | | |
| | . | | | | | |
| | $F_5$ | | | | | |
| TC | $F_3$ | | | | | |
| | . | | | | | |
| | . | | | | | |
| | $F_5$ | | | | | |
| TD | $F_3$ | | | | | |
| | . | | | | | |
| | . | | | | | |
| | $F_5$ | | | | | |

The data $\omega_{ci}$, $\omega_{c2}$, $\omega_{c3}$, ..... stored as frequency data $\omega_{ci}$ of the carrier in each small area of the parameter ROM 81 represents a harmonic frequency $kf_0$ (different depending upon the keys $F_3$ . . . $F_5$) which is nearest to the i-th (i=1,2 . . .8) formant center frequency $F_{fi}$ (i.e., $f_{f1}$, $f_{f2}$, . . .$f_{f8}$) in a fixed formant for a desired tone color TA, TB, TC or TD. The data $\omega_{mi}$, $\omega_{m2}$ . . . stored as frequency data $\omega_{mi}$ of the modulating wave represents the fundamental frequency $f_0$ of the key ($F_3$ . . . $F_5$). The data $I_1$, $I_2$, . . . representing the modulation index $I_i$ is a modulation index for determining a spectrum envelope of the i-th (i=1, 2 . . . 8) formant in the fixed formant for realizing the tone color. In the level correction by controlling of the modulation index $I_i$ is effected by prestoring, as the data $I_1$, $I_2$ ... representing the modulation index $I_i$, a value $SI_i$ obtained by applying modification (S) to the original modulation index in accordance with the frequency difference Δf between the center frequency $f_{fi}$ of the original formant and the carrier ($\omega_{ci}$). The level data $L_i$ represents the level ($L_i$, $L_2$ ... ) of the i-th (i=1, 2 .... 8) formant in the fixed formant for realizing the tone color. In case the level correction according to the invention is made by correcting an amplitude level in the same manner as in the embodiment shown in FIG. 6, data (corresponding to the level data (L+l). in FIG. 8) obtained by correcting the original level ($L_i$) by the level correction amount $l_i$ in accordance with the frequency difference Δf between the original formant center frequency $f_{fi}$ and the carrier ($\omega_{ci}$) is prestored as the level data $L_1$, $L_2$, $L_3$ ...

One of the large areas corresponding to a desired one of the tone colors TA, TB, TC and TD is selected by the voice code VC applied from the voice selector 83 to a large area address input AD1 of the parameter ROM 81. A depressed key detection circuit 84 detects a key being depressed in a keyboard 82 and produces a key code KC representing the depressed key and a key-on signal KON. The key code KC is applied to a middle area address input $AD_2$ of the parameter ROM 81 for selection of one of the middle area corresponding to the depressed key in the large area selected by the voice code Vc. A formant counter 85 has modulo N=8 corresponding to the number N of formants and is counted up by the clock pulse $\phi$. The output of the counter 85 is applied as a formant number designation code iC to a small area address input $AD_3$ of the parameter ROM 81 for time shared reading of the data $\omega_c$, $\omega_{mi}$, $I_i$ and $L_i$ of each formant (i=1, 3, . . . 8) from each small area of one middle area specified by the voice code VC and the key code KC. Time division timing of each formant (i=1, 2 . . . 8) is the same as i in FIG. 13 (N=8).

An FM computation circuit 86 performs, in the same manner as the FM computation circuit 16 in FIG. 6, the frequency modulation computation as shown in the formula (3) on the basis of the computation parameters $\omega_{ci}$, $\omega_{mi}$, $I_i$ and $L_i$ of each formant (i=1, 2 . . . 8) read from the parameter ROM 81 on a time shared basis. The data $\omega_{ci}$ of the same order is cumulatively added on a time shared basis in an accumulator consisting of an adder 89 and a shift register 88 of 8(=N) stages and phase angle data $q\cdot\omega_{ci}$ of the carrier thereby is produced. On the other hand, the data $\omega_{mi}$ of the same order is cumulatively added on a time shared basis in an accumulator consisting of an adder 89 and shift register 90 of 8(=N) stages and phase angle data $q\cdot\omega_{mi}$ of the modulating wave thereby is produced. Frequency modulated wave amplitude data sin $q\cdot\omega_{mi}$ is read from a sinusoidal wave table 91 in response to the phase angle data $q\cdot\omega_{mi}$. In a multiplicator 92, the frequency modulated amplitude data sin $q\cdot\omega_{mi}$ is multiplied with the modulation index $I_i$ read from the parameter ROM 81 to produce data $I_i$ sin $q\cdot\omega_{mi}$. In an adder 93, the modulated wave amplitude data $I_i$ sin $q\cdot\omega_{mi}$ is added to a phase angle data of the carrier. The frequency modulated signal sin $(q\cdot\omega_{ci}+I_i \sin q\cdot\omega_{mi})$ is read from a sinusoidal wave table 94 in response to the output of the adder 93. The frequency modulated signal read from the sinusoidal wave table 94 is supplied to a multiplicator 95 in which it is multiplied with an amplitude coefficient Ai.

The key-on signal KON outputted by the depressed key detection circuit 84 is applied to an envelope generator 96 and a signal D(t) representing an amplituide envelope from starting of sounding of a tone to extinguishing thereof is generated in accordance with the depression of the key. In a multiplicator 97, the level data Li of each formant read from the parameter ROM 81 is multiplied with the amplitude envelope signal D(t) to produce the amplitude coefficient Ai of the frequency modulated signal.

The frequency modulated signal Ai $\sin(q\cdot\omega_{ci}+I_i \sin q\cdot\omega_{mi})$ outputted by the multiplier 95 on a time shared basis is summed up by an accumulator 98 and thereafter is applied to a register 99. The clock pulse $\phi$ is utilized as a timing signal ACC for the addition conducted in the accumulator 98. The accumulator 98 in cleared by a clear control signal CLR which is produced in the same manner as in FIG. 13 upon lapse of the time division timing for the last (i=N=8) formant. A load control signal LOAD of the register 99 is generated, in the same manner as in FIG. 13, in the latter half of the time division timing for the last (i=N=8) formant and a result of the addition in the accumulator 98 is loaded in the register 99 immediately before the accumulator 98 is cleared. Accordingly, the frequency modulated wave signal.

$$\sum_{i=1}^{8} Ai \sin(q \cdot \omega_{ci} + 1_i \sin q \cdot \omega_{mi})$$

which is equivalent
to the formula (3) is provided by the register 99. This output of the register 99 is converted to an analog signal by a digital-to-analog converter 100 whereby a tone is sounded through a sound system 101.

In the above described embodiments, the invention has been described as being applied to a monophonic electronic musical instrument. The invention is applicable also to a polyphonic electronic musical instrument. The FM computation circuits 16, 78 and 86 for forming a formant by frequency modulation computation have been described as circuits performing a most basic frequency modulation computation. A formant may be formed by a more complicated computation including a frequency modulation computation (e.g. a frequency modulation of multiple terms or a multiple frequency modulation or a combination of frequency modulation and amplitude modulation).

In the above described embodiments, an example in which a fixed formant is realized by the frequency modulation is desribed. The level correction according to the invention may be applied to other systems for forming a fixed formant with the nearest harmonic frequency being used as a central component (e.g. a system for forming a fixed formant by synthesizing harmonics). The means for designating a fundamental frequency ($f_0$) is not limited to the keyboard but other suitable means may be employed.

I claim:

1. An electronic musical instrument having note selection means for selecting one among a plurality of notes and a tone signal generation means for generating by frequency modulation a tone signal containing harmonic components corresponding to the note selected by said note selection means, said tone generation means being of the fixed formant, frequency modulation type and having formant synthesizing means for synthesizing formants included in said tone signal, comprising:

frequency modulation means for frequency-modulating a carrier of a second frequency by a modulating wave corresponding to the fundamental frequency of said selected note, thereby to form a certain formant having said second frequency as its center frequency, said second frequency being the frequency of that harmonic component of said selected note which is closest to a first frequency which is the center frequency of a predetermined fixed formant, and level correction means for correcting the level of said certain formant in response response to the difference between said first frequency and said second frequency.

2. An electronic musical instrument as defined in claim 1 wherein said level correction means comprises:

means for computing a frequency difference between said first frequency and said second frequency, said level of said certain formant being established by said frequency difference.

3. An electronic musical instrument as defined in claim 2 wherein said level correction means further comprises:

outputting means for outputting level correction data in response to said frequency difference; and controlling means for controlling said level of said certain formant in response to said level correction data.

4. An electronic musical instrument as defined in claim 3 wherein said outputting means outputs level correction data which causes an amplitude level of said formant to decrease as said frequency difference increases.

5. An electronic musical instrument as defined in claim 3 wherein said computing means obtains said frequency difference in a cent value and said outputting means outputs said level correction data of a magnitude corresponding to the cent value.

6. An electronic musical instrument as defined in claim 1 wherein said formant synthesizing means comprises:

detection means for detecting said second frequency.

7. An electronic musical instrument as defined in claim 6 wherein said detection means comprises:

first means for generating intermediate frequency data representing an intermediate frequency between respective harmonic frequencies; and second means for detecting intermediate frequencies adjacent to each other across said first frequency by comparing each intermediate frequency with said first frequency thereby to detect a harmonic frequency located intermediate between the two adjacent intermediate frequencies as the harmonic frequency nearest to said first frequency.

8. An electronic musical instrument as defined in claim 7 wherein said note selection means comprises:

key switch means having a plurality of key switches which correspond to said notes respectively; and a first table prestoring fundamental frequency numbers which represent fundamental frequencies of respective notes in a cent value relative to a predetermined reference frequency, and means for reading out the frequency number corresponding to said selected note in response to note selection by said key switch means;

said tone generation means further comprises:

voice selection means for selecting a desired fixed formant among a plurality of fixed formants; and a second table prestoring center frequency numbers which represent center frequencies of said plurality of fixed formants in a cent value relative to the predetermined reference frequency, and means for reading out the center frequency number of a selected fixed formant in response to the selection by said voice selection means;

said first means comprises a third table prestoring intermediate frequency numbers which represent intermediate frequencies that are intermediate harmonics of said fundamental frequency in a cent value relative to fundamental frequencies, and means for successively reading out these intermediate frequency numbers; and said second means comprises:

a first computation circuit for performing computation on the basis of the fundamental frequency number read from said first table and the center frequency number read from said second table to obtain data of the center frequency of the selected fixed formant expressed in a cent value relative to the fundamental frequency;

a comparison circuit for comparing the data obtained by said first computation circuit with the intermediate frequency number read from said third table;

a control circuit for detecting intermediate frequencies adjacent to each other across the center frequency of the fixed formant on the basis of the output of said comparison circuit to obtain an order of a harmonic frequency located intermediate the adjacent intermediate frequencies; and a second computation circuit for computing the fundamental frequency number in response to the order obtained by said control circuit to provide data representing the harmonic frequency nearest to the center frequency.

9. An electronic musical instrument as defined in claim 6 wherein said level correction means controls a modulation index in said frequency modulation means in response to difference between said first frequency and said second frequency.

10. An electronic musical instrument as defined in claim 9 wherein said level correction means further comprises:

a circuit for outputting modifying data which modifies the modulation index in such a manner that the modulation index increases with increase of said frequency difference between said first frequency and said second frequency; and a circuit for modifying the modulation index to be used in said frequency modulation means in accordance with said modifying data.

11. An electronic musical instrument as defined in claim 1, wherein said tone generation means further comprises:

selecting means for selecting a third frequency which is another harmonic frequency located in the vicinity of said first frequency; and subformant synthesizing means for synthesizing a subformant having said another harmonic frequency as a central component, said tone signal further including said third formant.

12. An electronic musical instrument as defined in claim 11 wherein said selecting means comprises:

a comparison circuit for comparing said first frequency with said second frequency; and a selecting circuit for selecting, as said third frequency, a harmonic frequency located next to said second frequency on a higher frequency side when said second frequency is lower than said first frequency and a harmonic frequency located next to said second frequency on a lower frequency side when said second frequency is higher than said first frequency, and wherein the level of the subformant synthesized by said subformant synthesizing means is lower than the level of said certain fixed formant.

13. An electronic musical instrument comprising:

note selection means;

voice selection means for selecting one set from among a plurality of sets of fixed formants;

fixed formant data supply means for outputting center frequencies and levels of fixed formants included in the set selected by said voice selection means;

formant synthesizing means for forming by frequency modulation a plurality of formants using, as central components thereof, harmonic frequencies among ones of the note selected by said note selection means which are nearest to center frequencies of the fixed formants provide by said fixed formant data supply means thereby to produce tone signals containing harmonic components of the selected note in accordance with these formants, and for setting levels of the tone signals in response to level data provided by said fixed formant data supply means with respect to each of these formants, said formant synthesizing means comprising:

detection means for detecting the harmonic frequency nearest to each center frequency of the fixed formants; and frequency modulation means for frequency modulating, on a time shared basis and with respect to each formant, a carrier having a frequency corresponding to each detected harmonic frequency by a modulating frequency corresponding to the selected note, and level correction means comprising:

means for calculating respective frequency differences between the center frequencies of the respective formants and the harmonic frequencies nearest to the center frequencies, and means for individually controlling the levels of the tone signals for the respective formants in said formant synthesizing means by modifying frequency modulation parameters in response to the calculated frequency differences.

14. An electronic musical instrument comprising:

a keyboard and tone generation means for generating a tone signal containing harmonic components corresponding to a key depressed in said keyboard in accordance with a desired fixed formant, said tone generation means comprising:

memory means for prestoring, with respect to each key in the keyboard, data representing a harmonic frequency which is nearest to a center frequency of the fixed formant and level control data corresponding to the difference between the center frequency of the fixed formant and the harmonic frequency nearest to the center frequency, data corresponding to the depressed key being read from the memory means, formant synthesizing means for synthesizing by frequency modulation a tone signal in accordance with a formant having as its central component a frequency represented by the nearest harmonic frequency data read from said memory means while controlling the level of the tone signal by the level control data read from said memory means, and wherein:

said formant synthesizing means consists of a frequency modulating circuit which frequency modulates a carrier having the frequency represented by the nearest harmonic frequency data for the depressed key, as obtained from said memory means, by a modulating wave having a frequency corresponding to the depressed key and controls an amplitude coefficient of the frequency modulated signal in response to said level control data read from said memory means.

15. An electronic musical instrument as defined in claim 14 wherein:

said memory means prestores the nearest harmonic frequency data and the level correction data for each key in the keyboard with respect to a plurality of fixed formants and also prestores modulating frequency data and modulation index data for each key of the keyboard with respect to the respective fixed formants and which further comprises:

control means for reading, on a time shared basis, the respective data corresponding to the depressed key from said memory means with respect to each of the fixed formants thereby causing said frequency modulation circuit to perform, on a time shared basis, the frequency modulation computation with respect to each of the formants on the basis of the read out data, and utilizing in said computation the read out modulating frequency data and modulation index data.

16. In an electronic musical instrument of the type wherein a musical tone is synthesized by frequency modulation of a carrier by a modulating wave, the modulation parameters of the carrier and modulating wave being selected to establish desired fixed formant characteristics, the improvement for ensuring correct harmonic component amplitudes for harmonic components having frequencies which are some distance from the center frequency of a fixed formant, comprising:

frequency difference determination means for determining the frequency difference between the frequency of a particular harmonic component and the fixed formant center frequency nearest thereto, and modulation parameter modification means, for modifying said modulation parameters in response to the determined frequency difference so as to decrease the effective amplitude of said particular harmonic component in proportion to the magnitude of said determined frequency difference.

17. The improvement of claim 16, wherein said modified modulation parameter is an amplitude coefficient.

18. The improvement of claim 17 further comprising: means having an amplitude coefficient of fixed value, said subordinate formant being formed by frequency modulation of a carrier having a frequency corresponding to that harmonic component which is nearest to said particular harmonic component but which corresponding frequency is on the other side of said fixed formant center frequency with respect to the frequency of said particular harmonic component.

19. The improvement of claim 16 wherein said modified modulation parameter is the modulation index of said modulating wave.

* * * * *